US007418106B2

(12) United States Patent
Greuet et al.

(10) Patent No.: US 7,418,106 B2
(45) Date of Patent: Aug. 26, 2008

(54) APPARATUS AND METHODS FOR INCREASING MAGNETIC FIELD IN AN AUDIO DEVICE

(75) Inventors: Jean-Baptiste Greuet, San Diego, CA (US); Haoye Shen, San Diego, CA (US); Peter Sobczak, San Diego, CA (US); Bahman Khatam, Escondido, CA (US)

(73) Assignee: Nokia Corporation, Espoo (FI)

( * ) Notice: Subject to any disclaimer, the term of this patent is extended or adjusted under 35 U.S.C. 154(b) by 453 days.

(21) Appl. No.: 10/873,061

(22) Filed: Jun. 21, 2004

(65) Prior Publication Data

US 2005/0281425 A1 Dec. 22, 2005

(51) Int. Cl.
*H04R 25/00* (2006.01)

(52) U.S. Cl. ..... 381/331; 381/79

(58) Field of Classification Search ..... 381/79, 381/312, 315, 322, 326; 379/443, 444
See application file for complete search history.

(56) References Cited

U.S. PATENT DOCUMENTS 2,911,605 A * 11/1959 Wales, Jr. ..... 336/200
5,360,388 A 11/1994 Spindel et al.
6,108,433 A 8/2000 Norris
6,600,399 B1 7/2003 Trandafir
2002/0136424 A1 * 9/2002 Usuki et al. ..... 381/401
2003/0003864 A1 * 1/2003 Locke ..... 455/41
2003/0161482 A1 8/2003 Miller et al.

* cited by examiner

*Primary Examiner*—Sinh Tran
*Assistant Examiner*—Walter F Briney, III
(74) *Attorney, Agent, or Firm*—Alston & Bird LLP

(57) ABSTRACT

An audio device is provided that is in electrical communication with a magnetic coil for the purpose of increasing magnetic field emissions generated by the device. The magnetic coil may be disposed on a flexible substrate in multi-turn and multi-layer format or disposed on a foldable flexible substrate in multi-turn and multi-layer format. Additionally, the magnetic coil may be disposed on the device's printed circuit board or the coil may be a freestanding, substrate-free coil assembly. The magnetic coil may be placed and secured in various locations within the device to maximize magnetic field emissions and minimize problems related to space limitations. The increased magnetic field results in a device that is hearing-aid compatible as defined by the Federal Communications Commission.

36 Claims, 23 Drawing Sheets

APPARATUS AND METHODS FOR INCREASING MAGNETIC FIELD IN AN AUDIO DEVICE

FIELD OF THE INVENTION

The present invention relates to audio devices and, more specifically, to apparatus and methods for increasing the magnetic field in mobile telephones or other audio devices for the purpose of Hearing Aid Compatibility (HAC).

BACKGROUND OF THE INVENTION

Recently the Federal Communications Commission (FCC) mandated that by July 2005, hearing-aid compatibility will be required on at least two mobile telephone models for each protocol sold in the United States and, by 2008, fifty percent of all the mobile telephone models sold in the United States must be Hearing-Aid Compatible (HAC).

In order for a telephone to be HAC, the telephone must deliver enough magnetic field proximate the ear speaker so that the hearing-aid device, which is in T-coil mode, can pick-up the magnetic field delivered by the phone. The FCC relies on standards, such as American Natural Standards Institute (ANSI) C63.19-2001, 68 FCC part 68 (47 C.F.R. 68) and International Telecommunication Union-Telecommunication (ITU-T) standards to define the requirements for hearing-aid compatibility. For example, in order for a mobile telephone to be considered compliant under the FCC ruling it must meet ANSI C63.19-2001 Category U3 radio frequency performance standards. Currently, not all mobile telephones, and certain other audio devices, being sold in the United States meet the FCC requirements and, thus, some form of device redesign will be required in order to meet the FCC requirements. While many possible solutions for redesign exist they must be able to compete with the current trends in mobile telephone manufacturing, in particular, decreasing size of the mobile telephone and decreasing cost of the units. Thus, in order for a solution to the magnetic field problem to be viable, the solution must minimize the amount of space it will occupy within the mobile telephone housing (i.e., handset, headset or other such housing) and it must be an economically feasible solution that will not impart any unnecessary additional costs to the unit price of the mobile telephone. The space minimization concern becomes exasperated as more and more features are added to the mobile telephone platform and many other handheld audio devices.

Thus, a need exists to develop an apparatus and method for increasing the magnetic field within a mobile telephone. The desired device and method should increase the magnetic field such that it meets the hearing-aid compatibility requirements mandated by the FCC. Additionally, the desired device and methods should be size compatible with current trends in mobile telephone manufacturing. In this regard, the desired device should increase the magnetic field without having to increase the size of the mobile telephone and, in particular the size of the ear speaker. Also, the desired device and method should be economically feasible, in that, it should minimize unnecessary additional costs related to manufacturing.

BRIEF SUMMARY OF THE INVENTION

The present invention provides for a magnetic coil assembly associated with an audio device such that the magnetic field emitted by the coil provides the requisite emission required for hearing-aid compatibility. Typically, the audio device will be a mobile terminal equipped with an audio transducer, such as a mobile telephone. In such embodiments the magnetic field emitted by the coil will typically combine with the magnetic field of the transducer to provide an overall increase in the magnetic field. The design of the magnetic coil may take various described forms, so as to provide options in terms of the placement position within the device housing. The design of the coil takes into account the space constraints within the device housing and the need to limit manufacturing costs associated with the magnetic coil. The increase in magnetic field emission provided by the coil will provide for audio transducer-equipped devices, such as mobile telephones, to comply with pending FCC requirements for Hearing-aid Compatibility (HAC).

In one embodiment of the invention an audio device is defined. The audio apparatus includes one or more driver circuits, a transducer in electrical communication with one of the driver circuits that provides for a transducer magnetic field and a magnetic coil in electrical communication with one of the one or more driver circuits that provides for a magnetic field emission that combines with the transducer magnetic field to result in an overall increased magnetic field. Typically, the magnetic coil and the transducer will share a single audio driver circuit and will be electrically connected either in series or in parallel. However, in an alternative embodiment the magnetic coil may have a separate audio driver circuit that operates independent of the transducer. In certain alternate embodiments, the audio device may operate without the need to incorporate a transducer.

The magnetic coil will typically be located within the audio device housing proximate to the transducer. Location proximate to the transducer will generally insure that the magnetic fields emitted by the coil and the transducer combine to provide for the largest magnetic field possible. However, in alternate embodiments of the invention the magnetic coil may be remote from the audio device housing, typically positioned proximate the ear of the device's user or proximate the hearing aid pickup coil.

The magnetic coil will typically be formed in a multi-turn arrangement and, additionally, will typically be arranged in multiple layers. Multiple turns and multiple layers insure maximum magnetic field emission from the coil assembly. The magnetic coil may be disposed on a flexible substrate; disposed on a foldable flexible substrate, disposed on or within the device's printed circuit board or the coil may be a freestanding, substrate-free apparatus. In embodiments in which the coil is disposed on a flexible substrate it may be disposed on either planar side or both planar sides of the substrate. Additionally, the magnetic coil may be disposed on the substrate in a layered fashion, such that it exists in multiple planes. In the layered arrangements the coil may be separated and spaced apart by dielectric adhesive layers or some other suitable dielectric material.

The foldable flexible substrate provides for individual coil units that are separated by fold regions, such that folding the units, one upon another, provides for a stacked coil arrangement that increases the cumulative magnetic field emitted by the transducer of the audio device. The individual coil units may be symmetric in planar shape, such that folding of the units, approximately 180 degrees, results in superimposing the units one on top of another. Alternatively, the individual coil units may be asymmetric in planar shape, such that folding of the units results in an asymmetric stack of coils. Desired magnetic field emissions may dictate the shape of the coil units. Additionally the layout of the fold regions within the device may dictate that the resulting folded assembly has an asymmetric stacked configuration The magnetic coil may also be a freestanding, substrate-free assembly. Typically, such an assembly is assembled on a release layer or a release substrate. In this regard, the free-standing assembly may be a layered or stacked arrangement of coils that are separated and spaced apart by a dielectric adhesive layer.

In alternate embodiments of the invention the magnetic coil may be disposed on or within the printed circuit board located within the audio device. In such embodiment the coil may be printed on the circuit board in multi-layer format using a photolithography process or other suitable semiconductor processing techniques. Alternatively, the coil assembly may be bonded or otherwise affixed to the circuit board after it has been fabricated. Additionally, the magnetic coil may be embedded within the layers of the printed circuit board.

As discussed above, in other alternate embodiments the magnetic coil may a highly flexible coil that is embedded or otherwise attached to periphery device, such as some form of headgear. In these embodiments the magnetic coil will be in electrical communication, either wired or wireless, with the audio device.

The planar shape of the coil assembly and the number of turns and/or layers in the coil assembly will typically be dictated by the magnitude of the magnetic field emission desired and the space limitations within the audio device housing. In addition, space limitations within the housing will dictate where the coil assembly is located within the audio device. In various embodiments of the invention, the coil assembly may be located proximate the printed circuit board, proximate the transducer gasket or between the transducer and the external cover that houses the ear port.

The invention is also defined in a method for increasing the magnetic field generated by an audio device. The method includes the steps of providing a magnetic coil within an audio device housing that is proximate the transducer of the device, and driving the magnetic coil with an audio driver circuit during device operation to provide a magnetic field in addition to the transducer magnetic field. The magnetic coil that is provided may be a magnetic coil disposed on a flexible substrate, a magnetic coil disposed on or within the telephone's printed circuit board, a magnetic coil disposed in units on a foldable flexible substrate or an unsupported, substrate-free magnetic coil.

Thus, the present invention provides a simplistic apparatus that results in sufficient increase in the emission of a magnetic field within an audio device, typically a mobile telephone. The increase in the magnetic field resulting from the invention will allow audio devices to comply with the pending FCC hearing-aid compatibility standards for future audio devices. The magnetic coil of the present invention can be designed in various formats and located in various positions within the audio device, thus allowing for the coil to provide sufficient increase in magnetic field while adhering to the space limitation concerns within the interior confines of the audio device. Additionally, the proposed designs can be manufactured and implemented in cost efficient manners.

BRIEF DESCRIPTION OF THE DRAWINGS

Figure 1A:
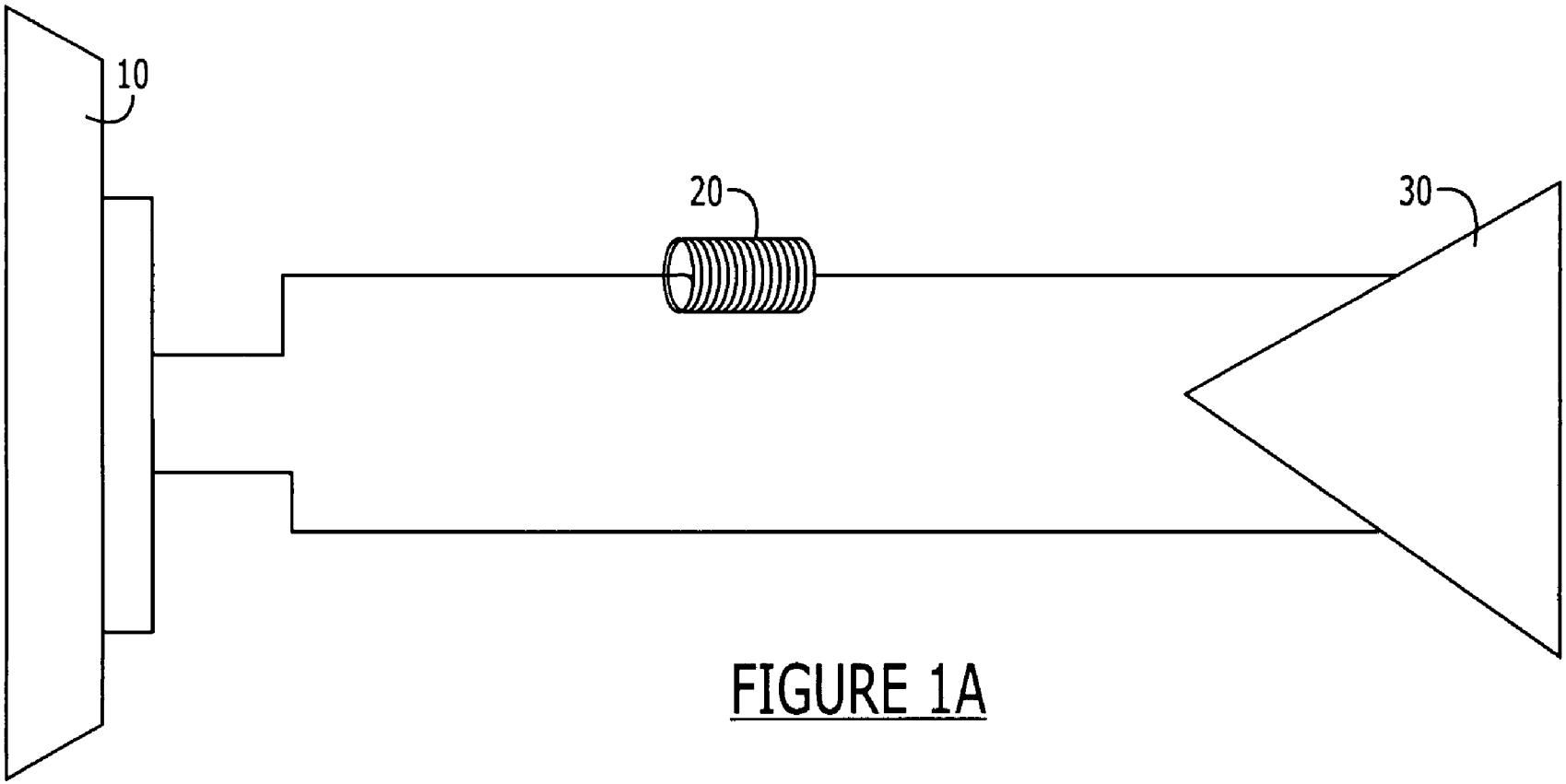

Having thus described the invention in general terms, reference will now be made to the accompanying drawings, which are not necessarily drawn to scale, and wherein:

FIG. 1A is a schematic drawing of a transducer, a magnetic coil and a driver circuit that are electrically connected in series, in accordance with an embodiment of the present invention.

Figure 1B:
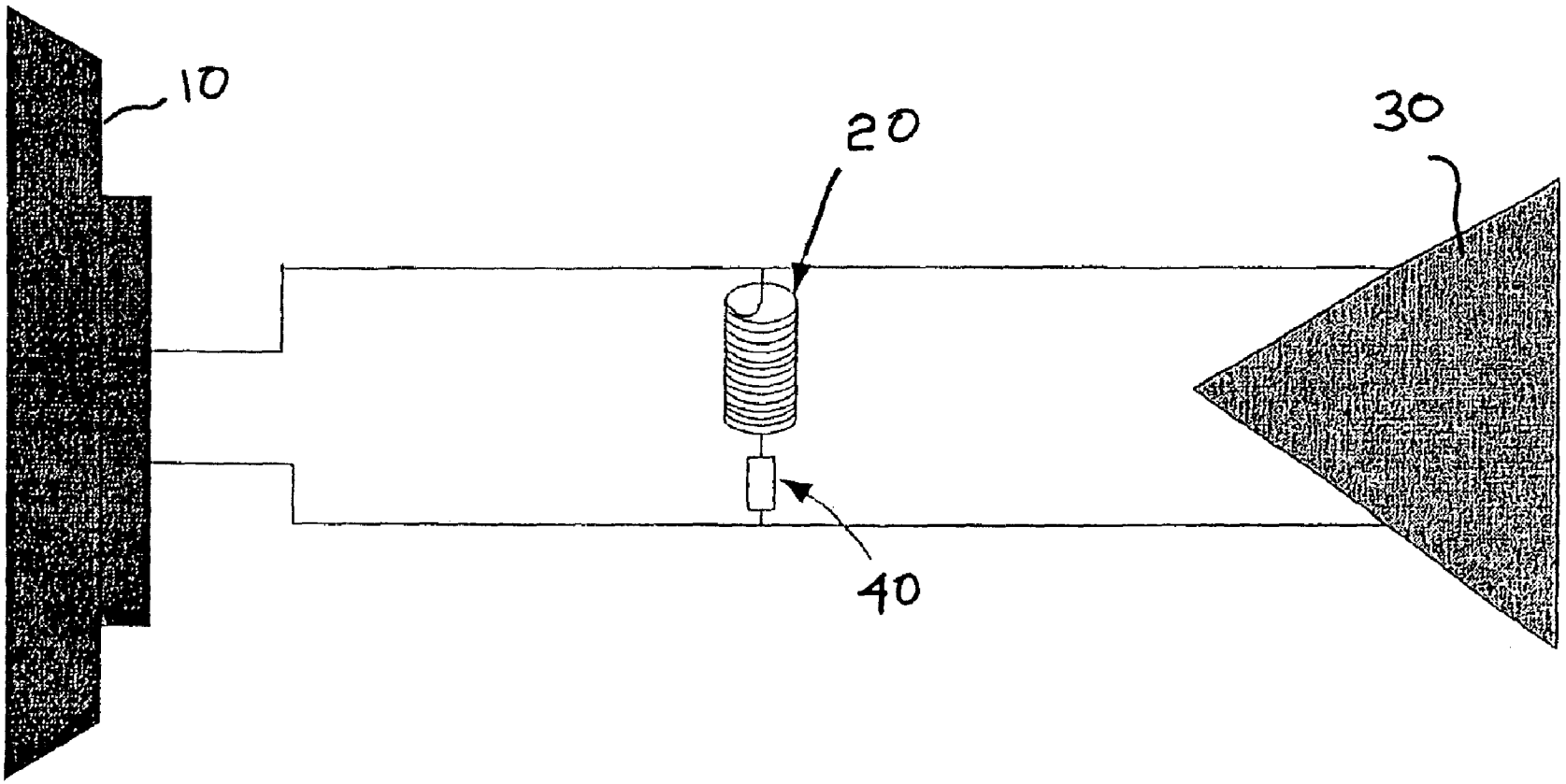

FIG. 1B is a schematic drawing of a transducer, a magnetic coil and a driver circuit that are electrically connected in parallel, in accordance with an embodiment of the present invention.

Figure 1C:
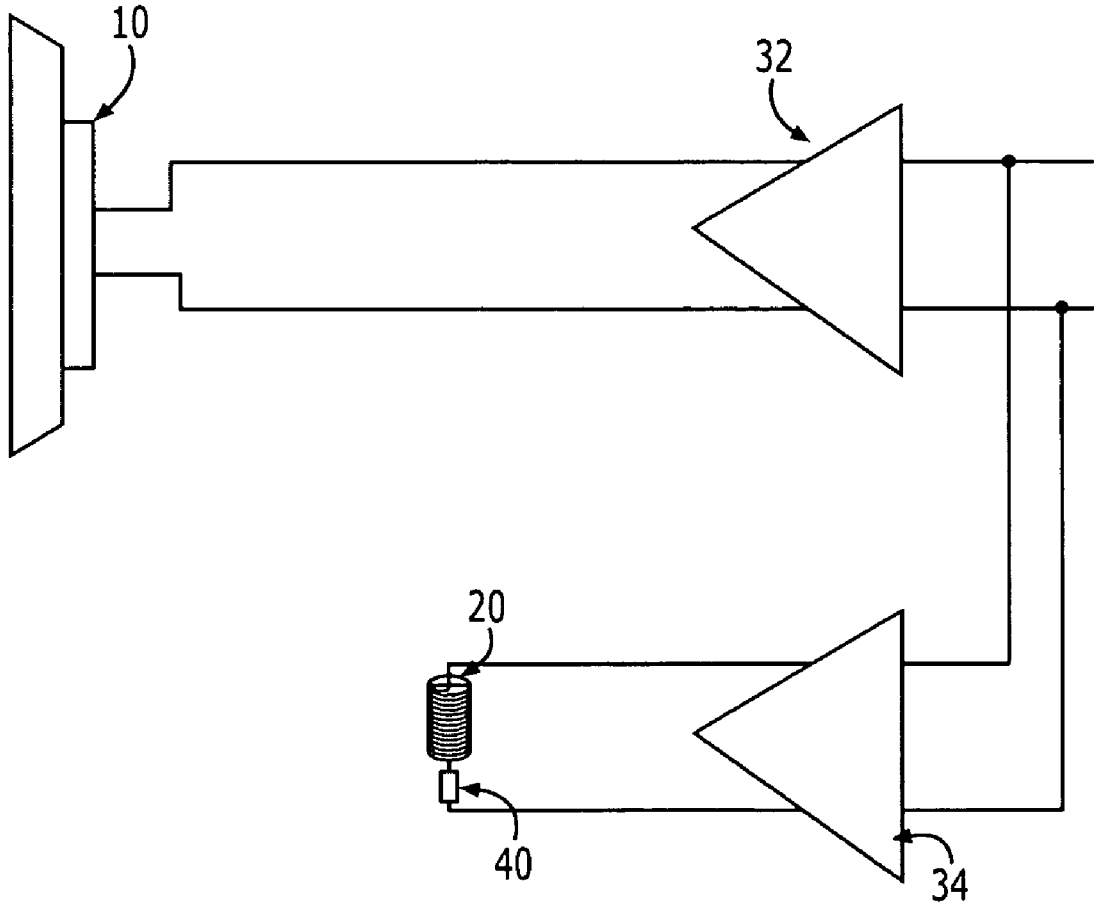

FIG. 1C is a schematic drawing of a transducer, a magnetic coil and dual driver circuits that are electrically connected in parallel, in accordance with an embodiment of the present invention.

Figure 1D:
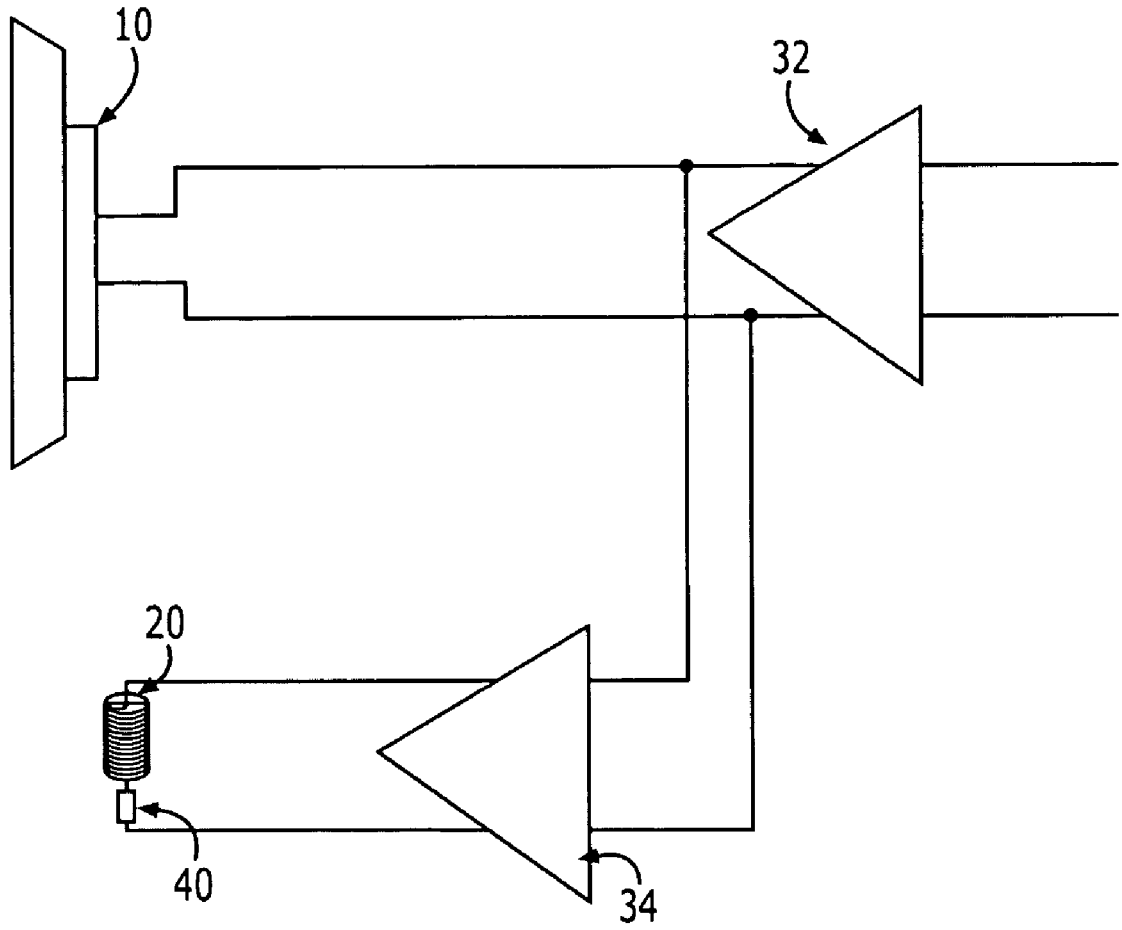

FIG. 1D is a schematic drawing of a transducer, a magnetic coil and dual driver circuit that are electrically connected in series, in accordance with an embodiment of the present invention.

Figure 1E:
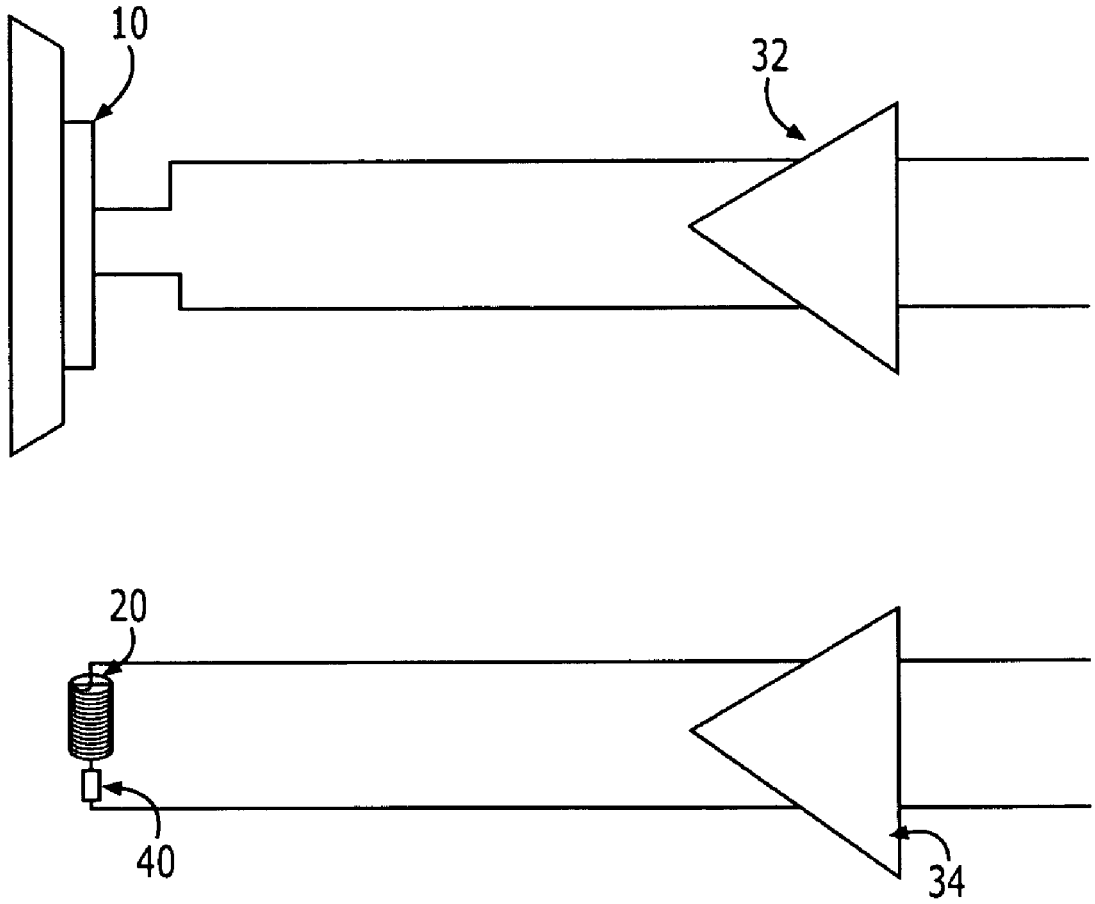

FIG. 1E is a schematic drawing of a transducer and a driver circuit and a magnetic coil and driver circuit, in accordance with an embodiment of the present invention.

Figure 1F:
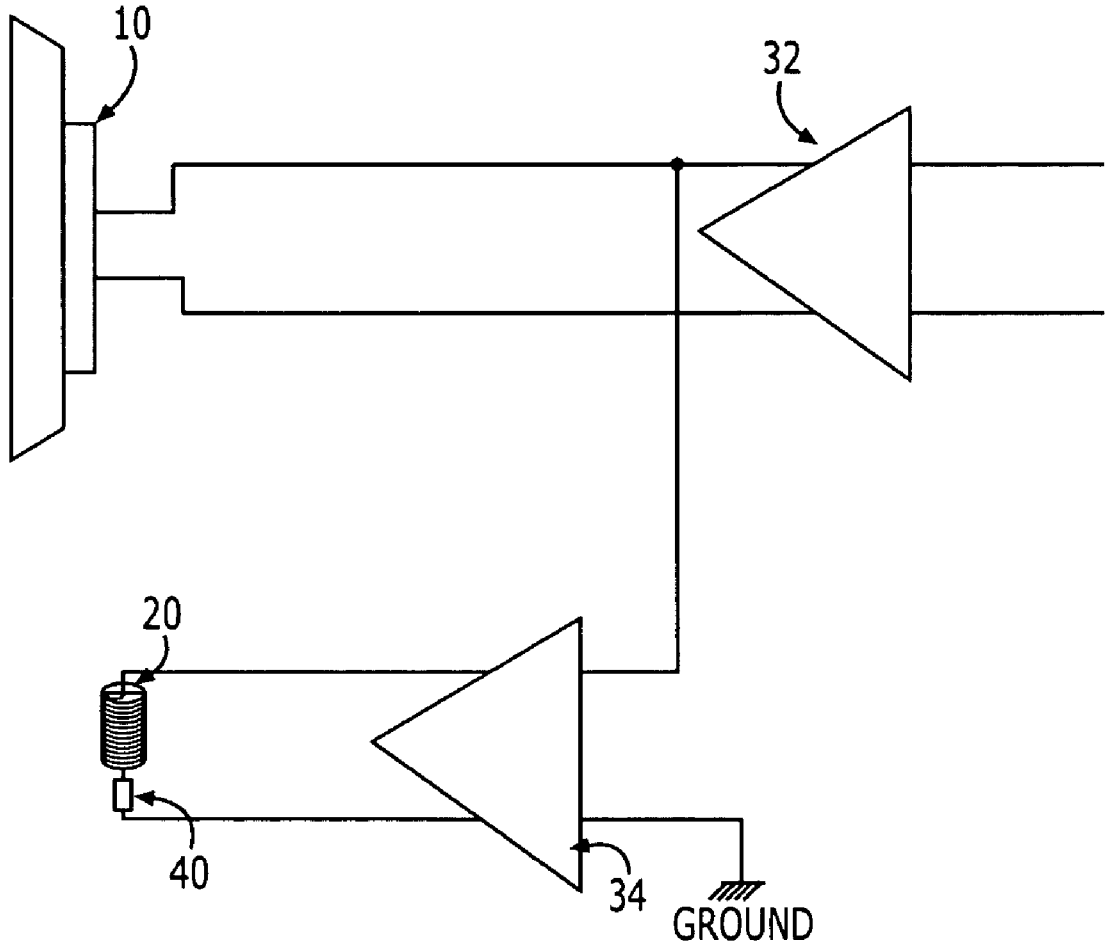

FIG. 1F is a schematic drawing of a transducer, a magnetic coil and dual driver circuits that are electrically connected in parallel with the transducer driver fully differential and the coil driver single ended input and differential output, in accordance with an embodiment of the present invention.

Figure 2:
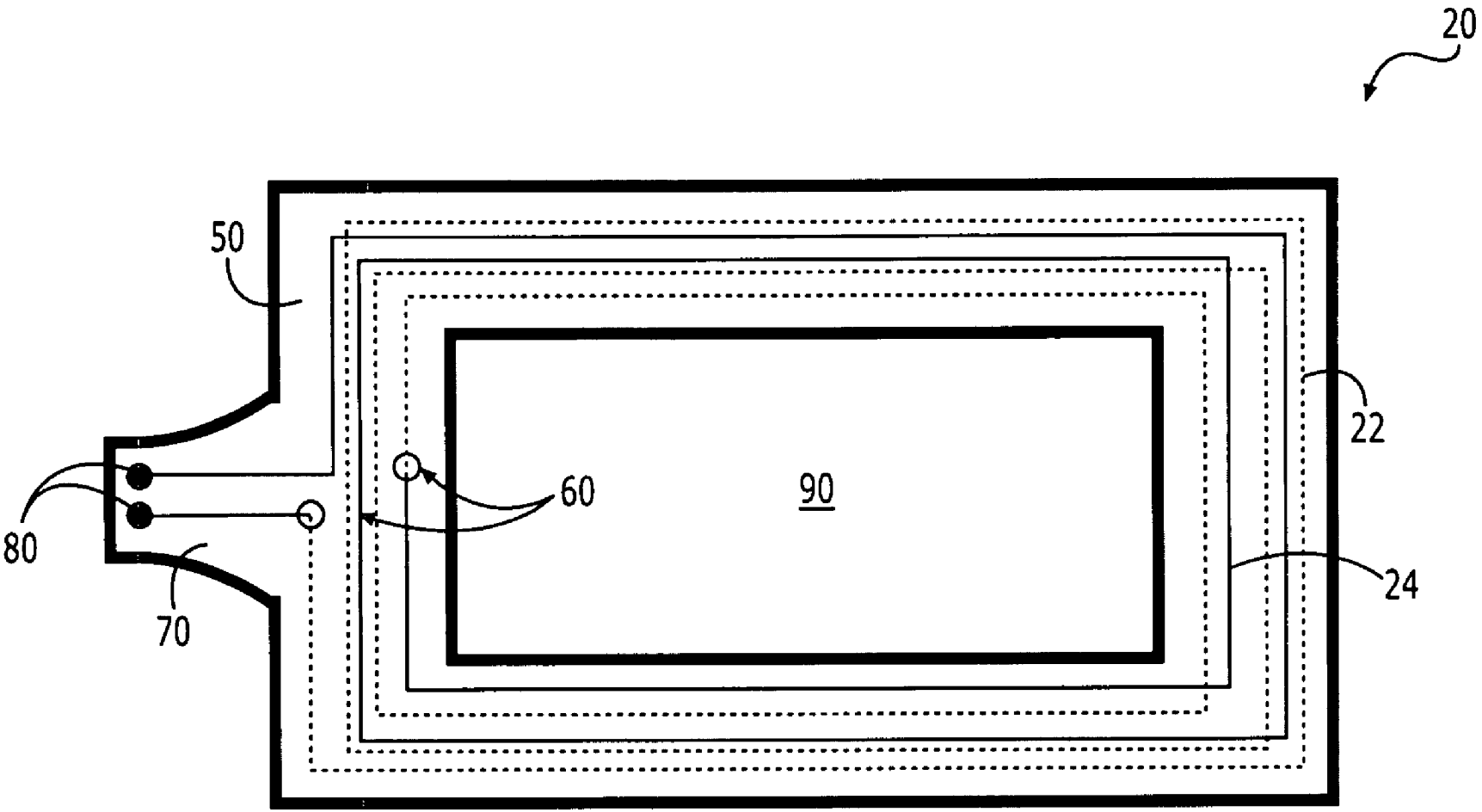

FIG. 2 is top-view representation of a magnetic coil assembly that is disposed on a generally rectangular planar shaped flexible substrate, in accordance with an embodiment of the present invention.

Figure 3:
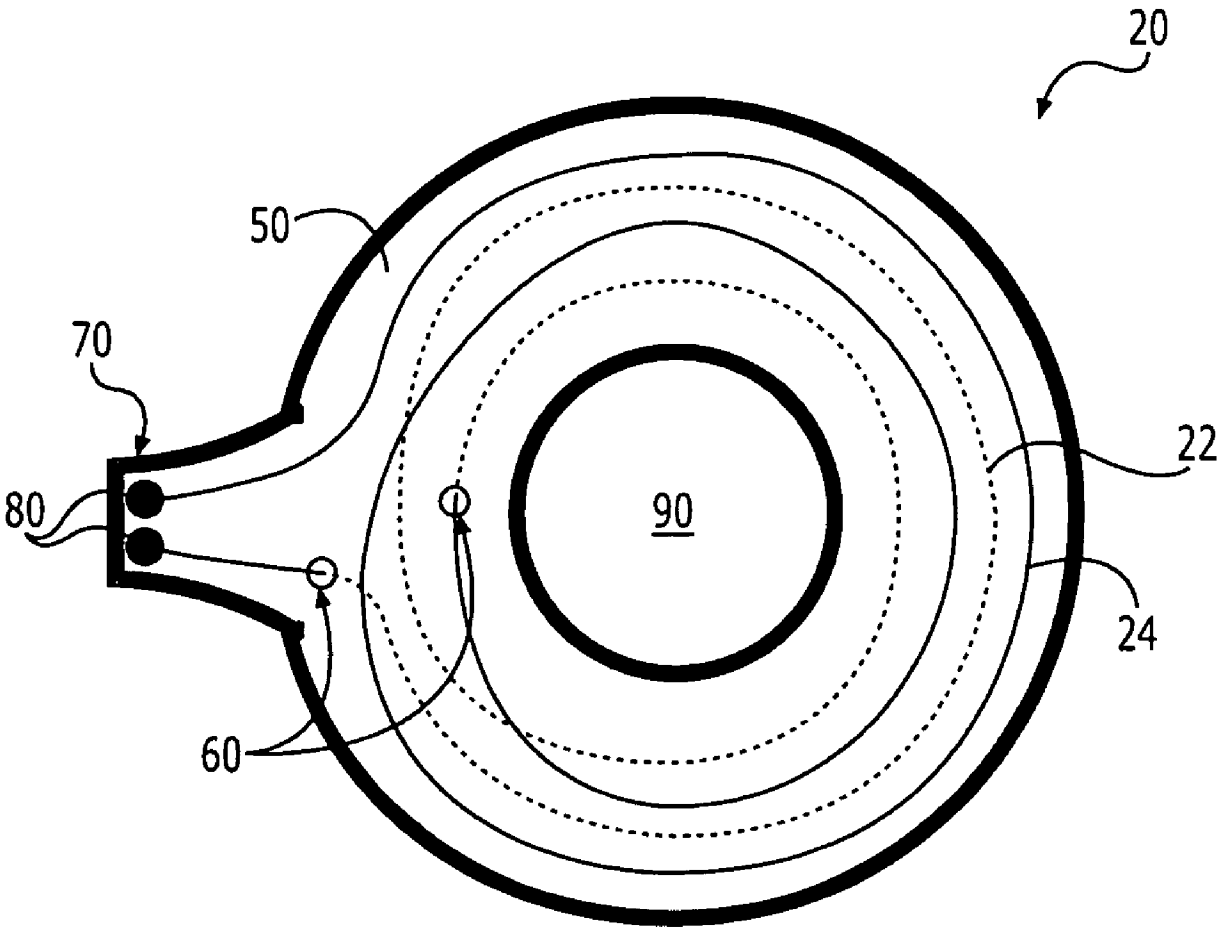

FIG. 3 is top-view representation of a magnetic coil assembly that is disposed on a generally circular planar shaped flexible substrate, in accordance with an embodiment of the present invention.

Figure 4B:
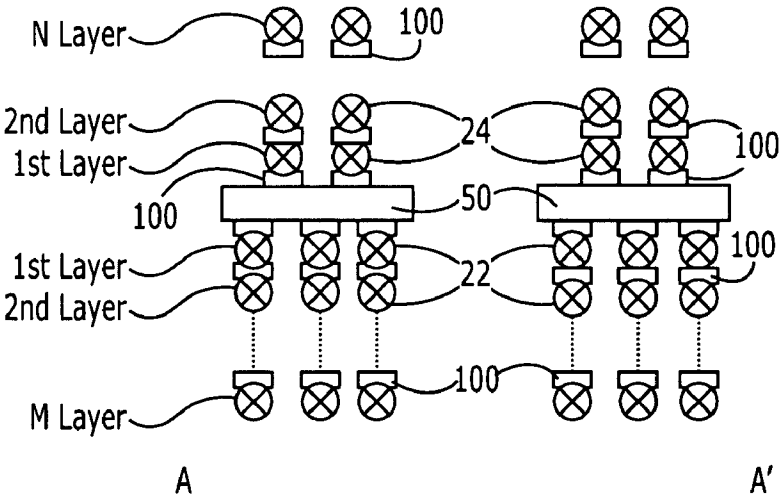
Figure 4A:
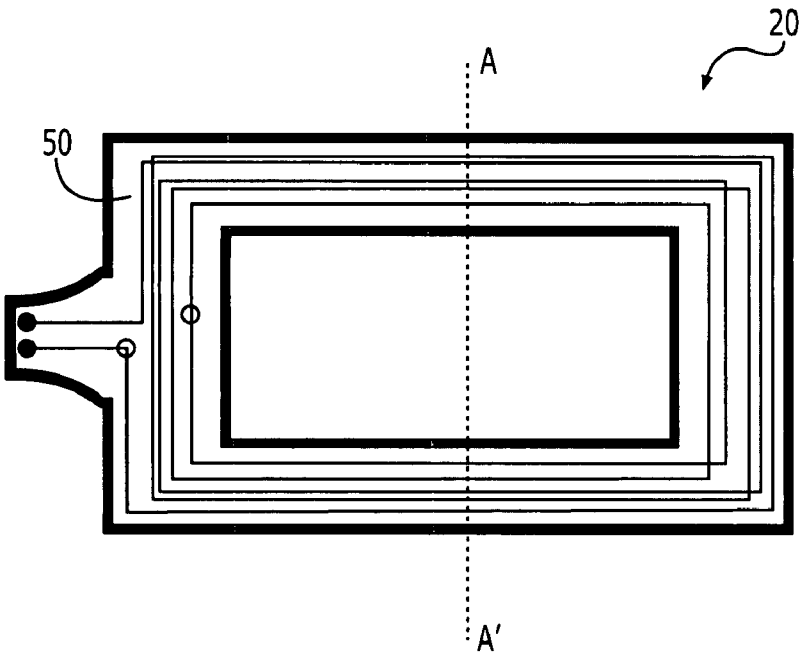

FIGS. 4A and 4B are a top-view and a cross-sectional view of a magnetic coil assembly that is disposed on both sides of a generally rectangular planar shaped flexible substrate and has multiple layers, in accordance with an embodiment of the present invention.

Figure 5:
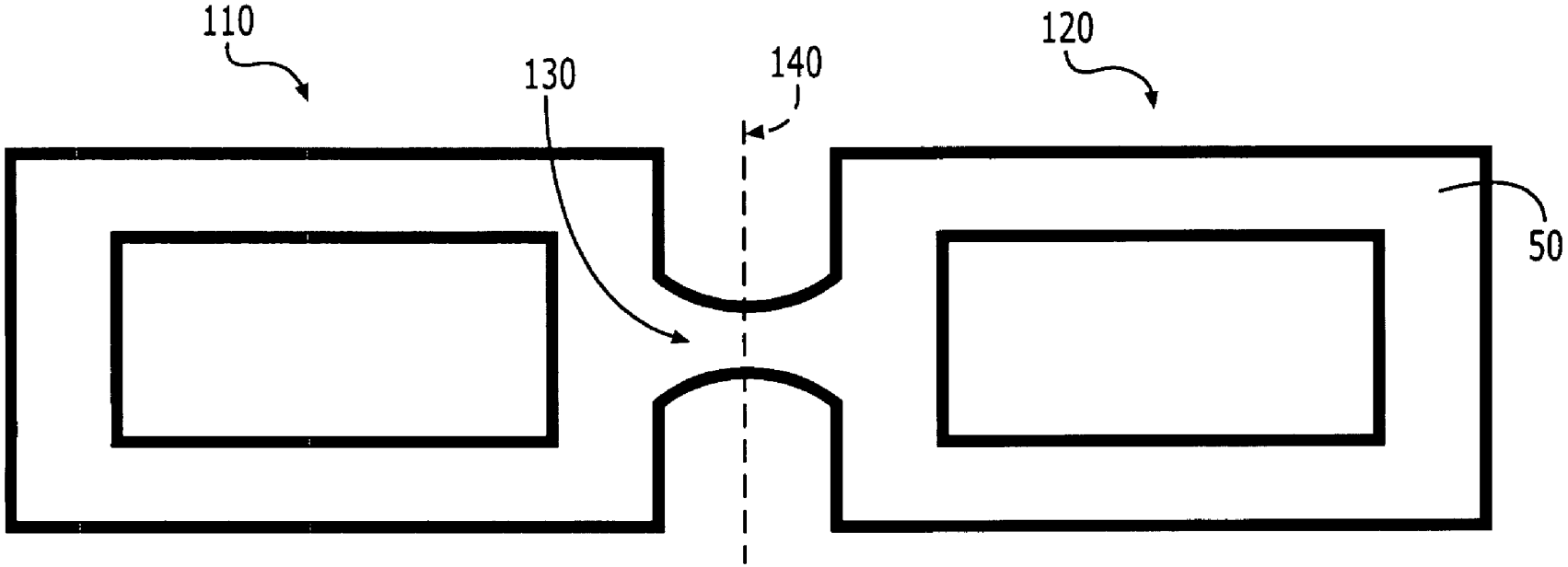

FIG. 5 is an illustration of a top-view of a configuration for a foldable flexible substrate having two magnetic coil units, in accordance with an embodiment of the present invention.

Figure 6:
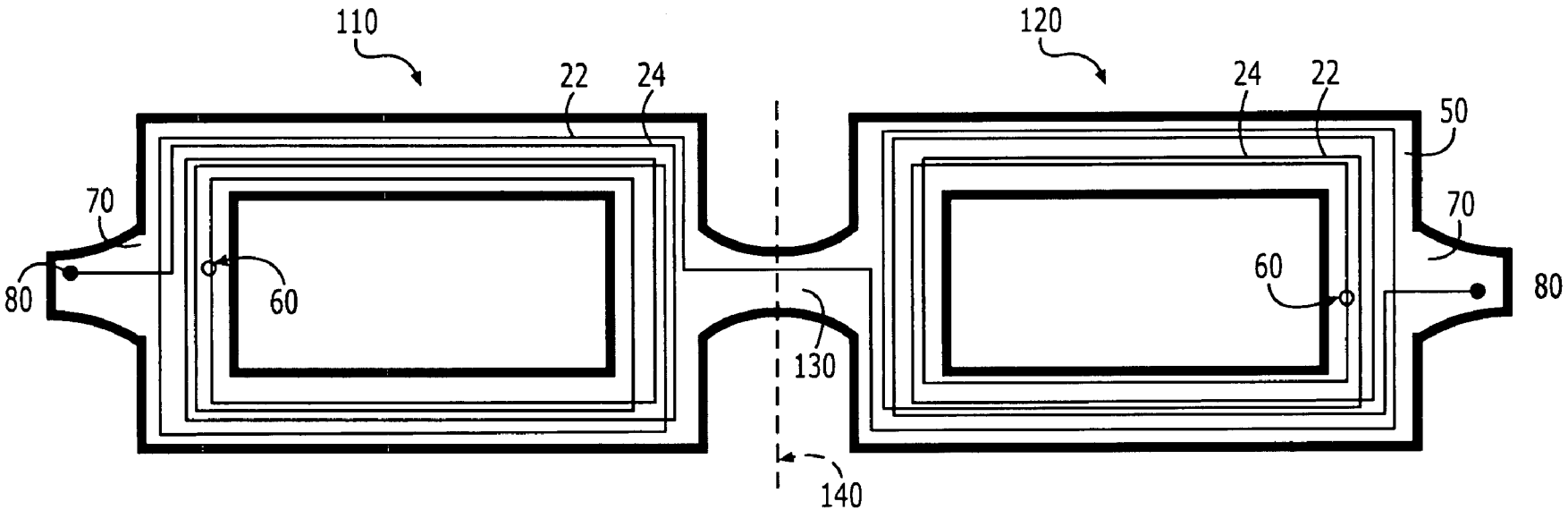

FIG. 6 is an illustration of a top-view of a foldable flexible substrate having multi-turn and multi-layered coils disposed on both sides of the two magnetic coil units, in accordance with an embodiment of the present invention.

Figure 7:
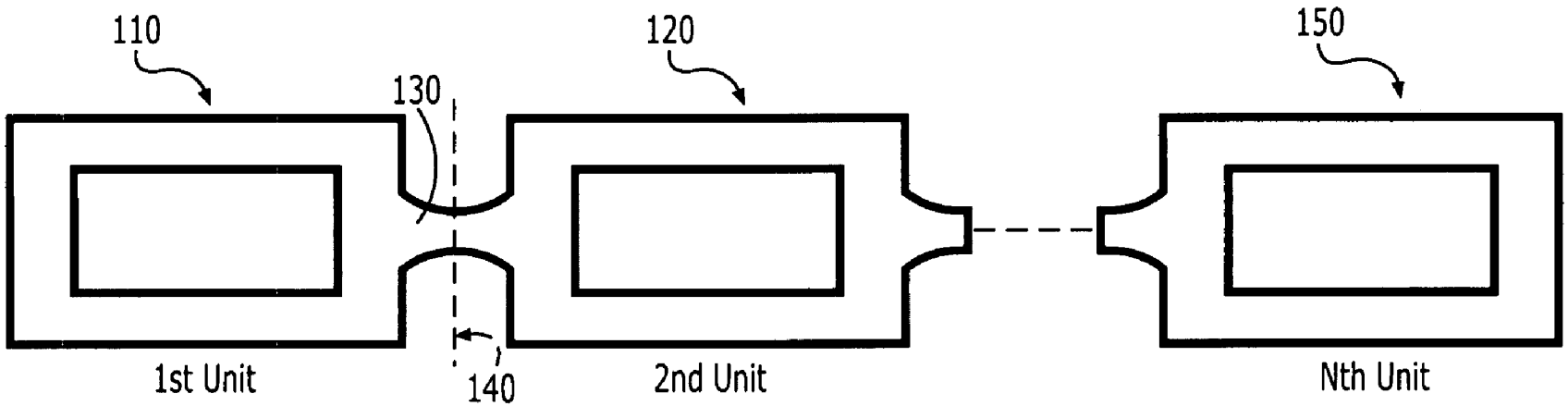

FIG. 7 is an illustration of a top-view of a configuration for a foldable flexible substrate having multiple magnetic coil units, in accordance with an embodiment of the present invention.

Figure 8A:
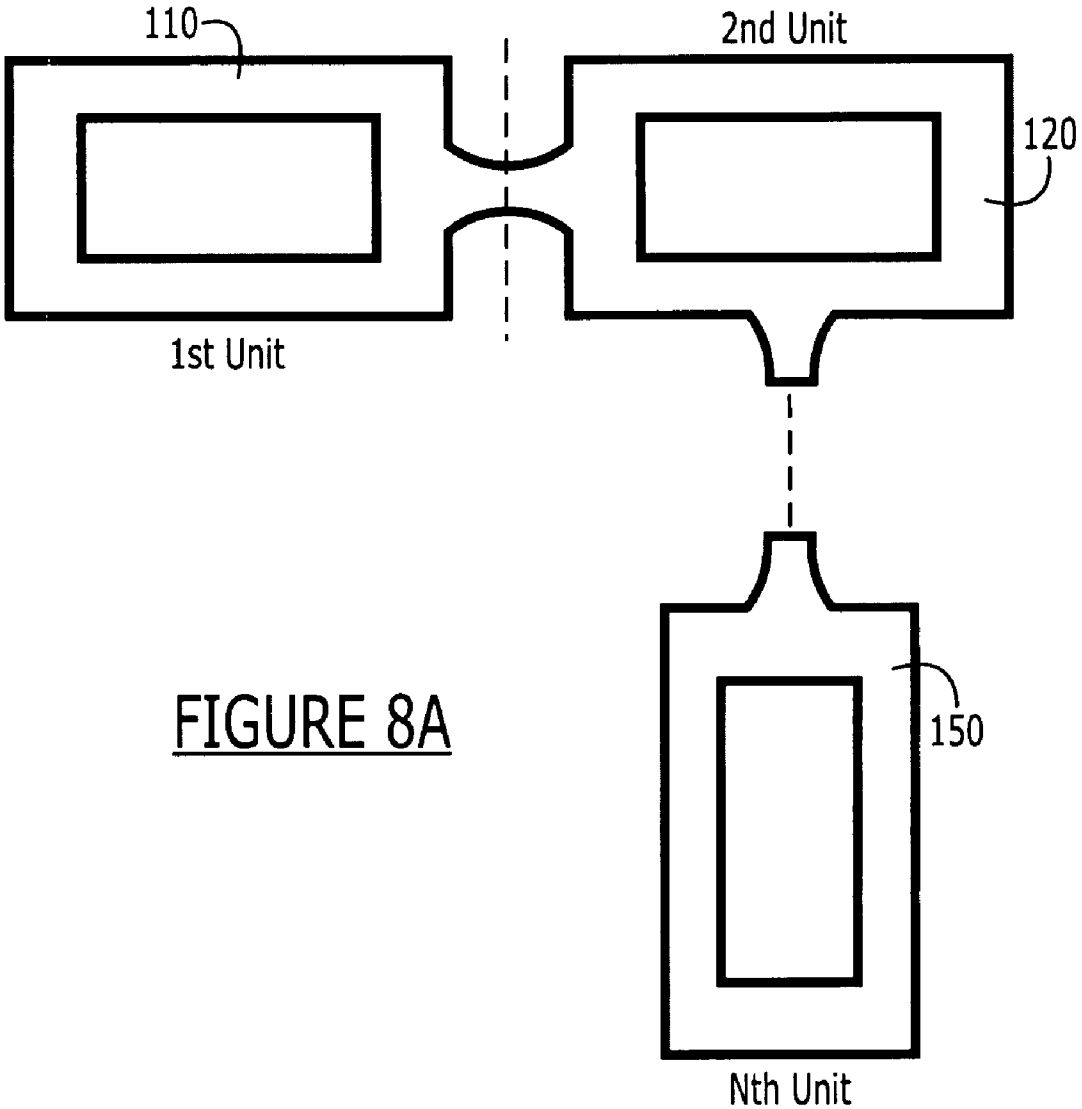
Figure 8B:
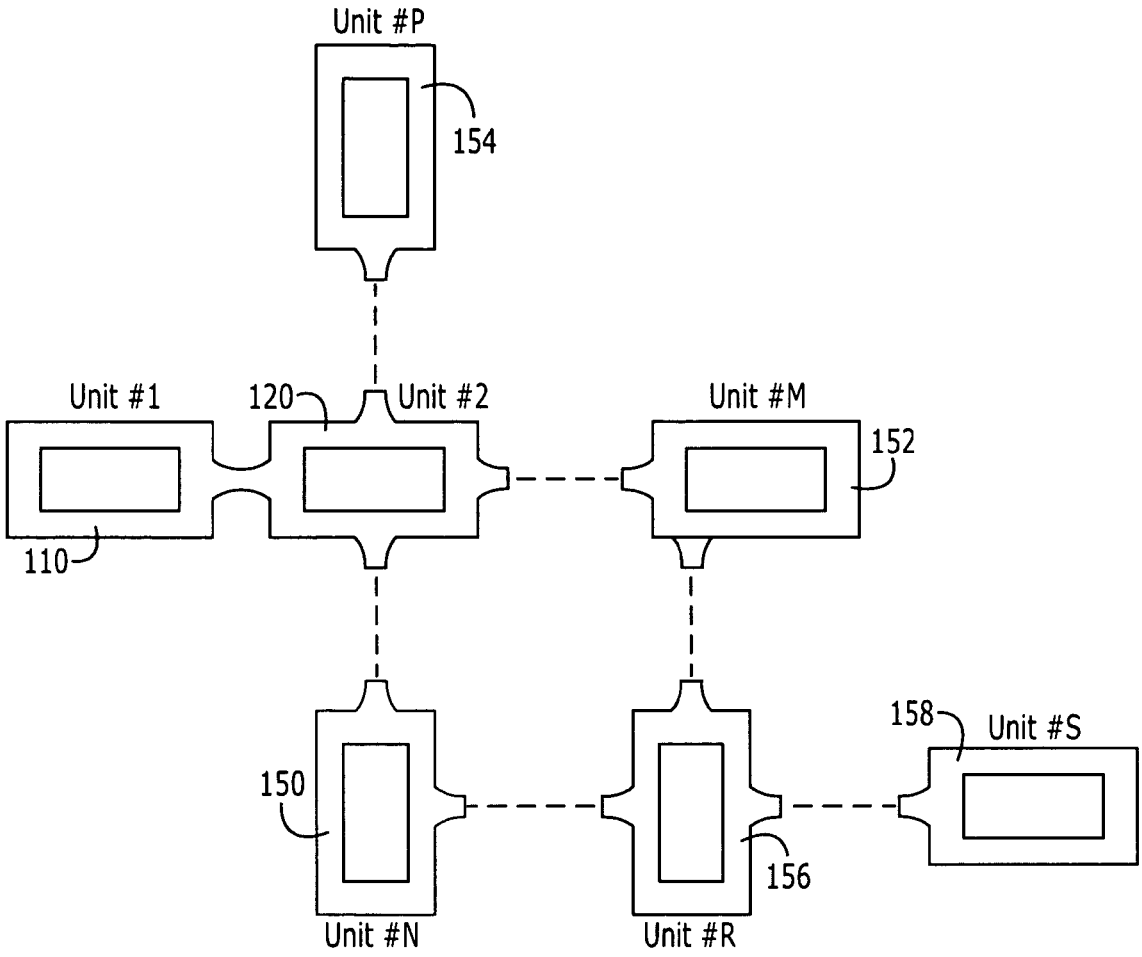
Figure 8C:
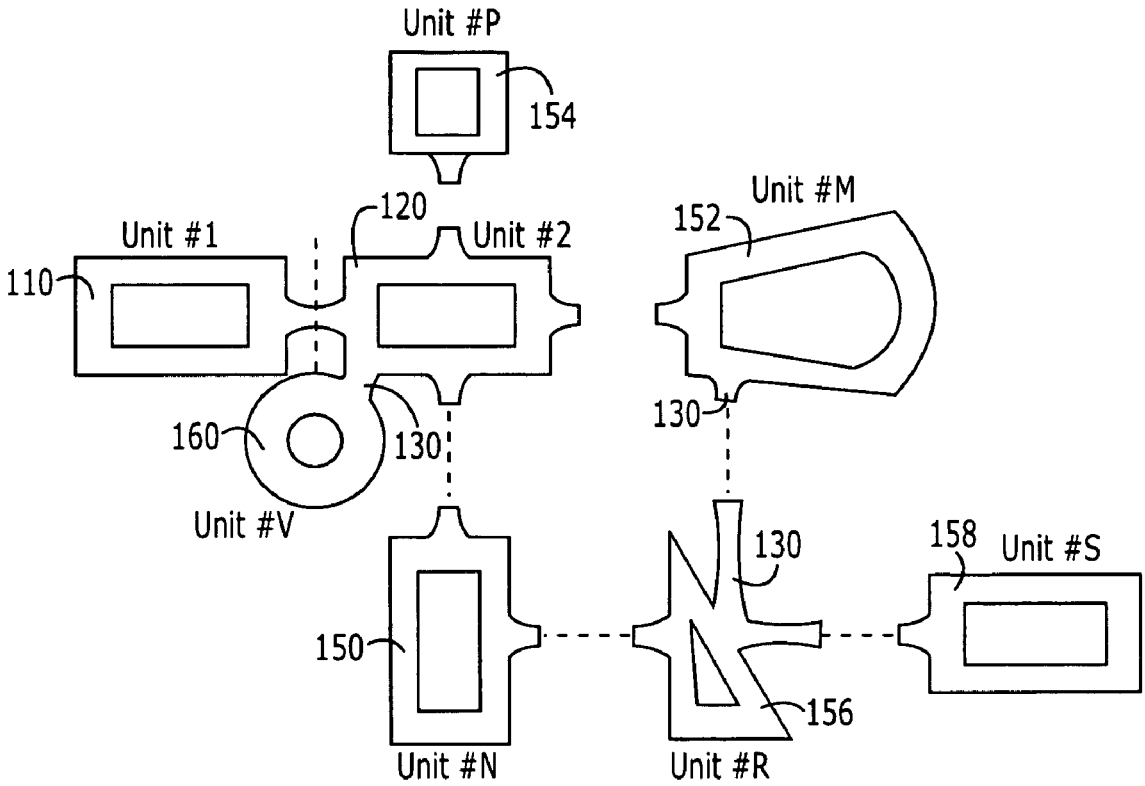

FIG. 8A-8C are top-view illustrations of configurations for a foldable flexible substrate having multiple magnetic coil units and configured such that folds in the substrate will result in an asymmetric stacking of coil units, in accordance with an embodiment of the present invention.

Figure 9:
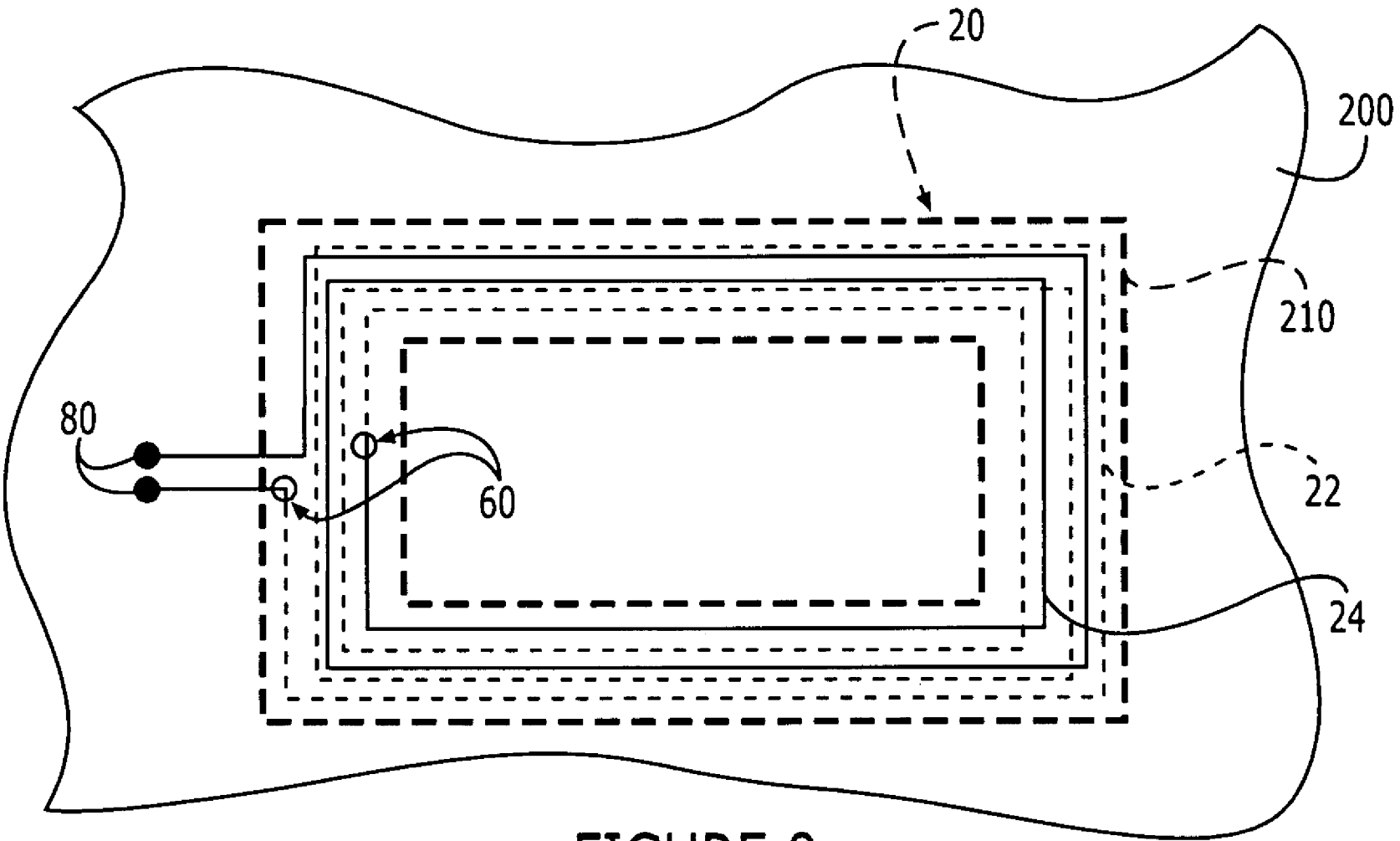

FIG. 9 is a top-view representation of a magnetic coil assembly that is disposed on a printed circuit board in a generally rectangular configuration, in accordance with an embodiment of the present invention.

Figure 10:
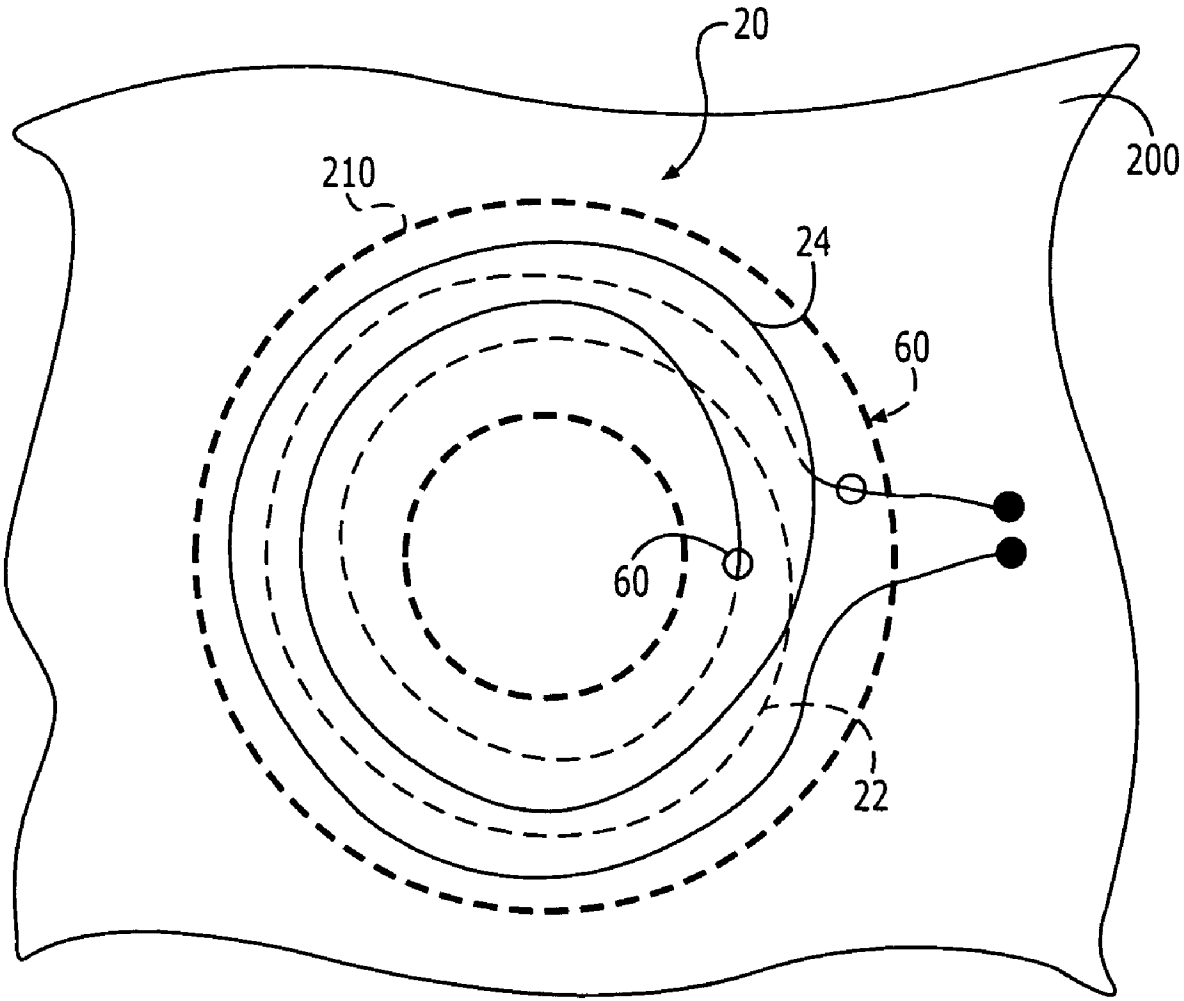

FIG. 10 is a top-view representation of a magnetic coil assembly that is disposed on a printed circuit board in a generally circular configuration, in accordance with an embodiment of the present invention.

Figure 11:
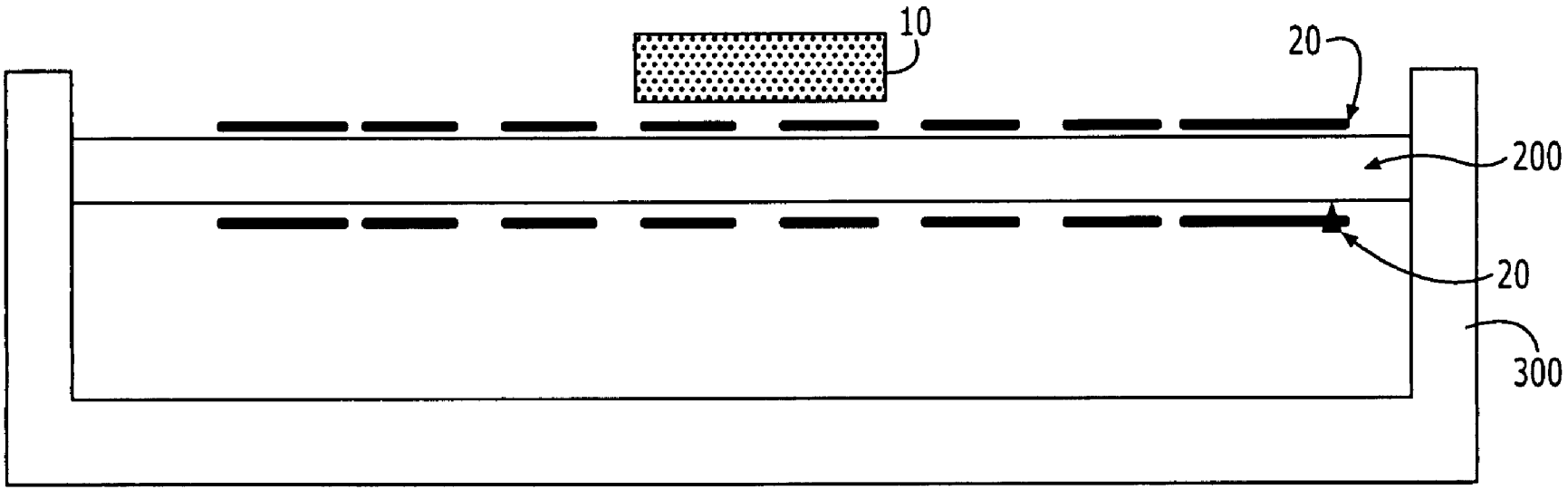

FIG. 11 is a cross-sectional diagram of the interior of a mobile telephone highlighting the disposal of the magnetic coil on the telephone's printed circuit board, in accordance with an embodiment of the present invention.

Figure 12:
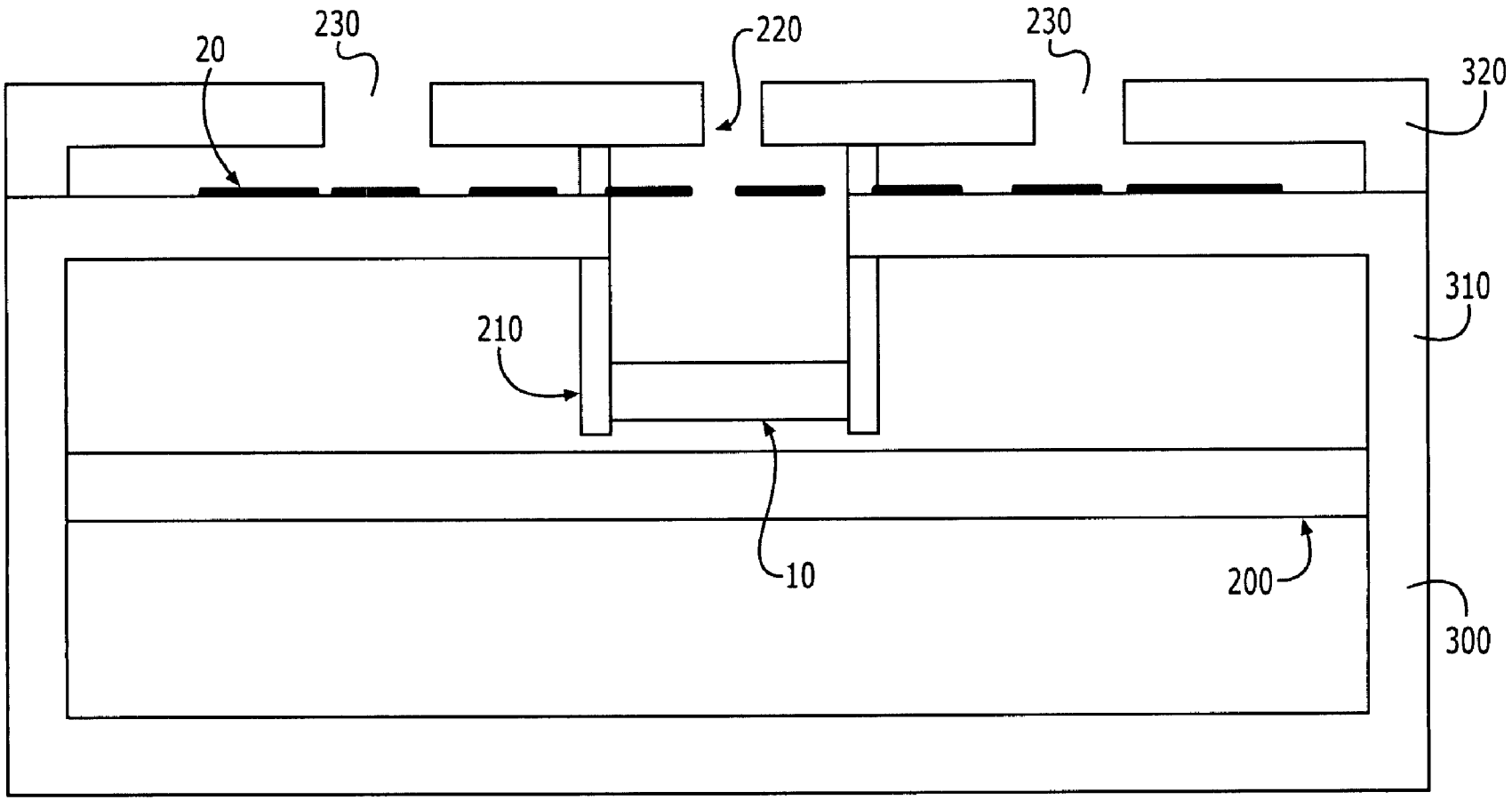

FIG. 12 is a cross-sectional diagram of the interior of a mobile telephone highlighting the disposal of the magnetic coil on the second cover, in accordance with an embodiment of the present invention.

Figure 13:
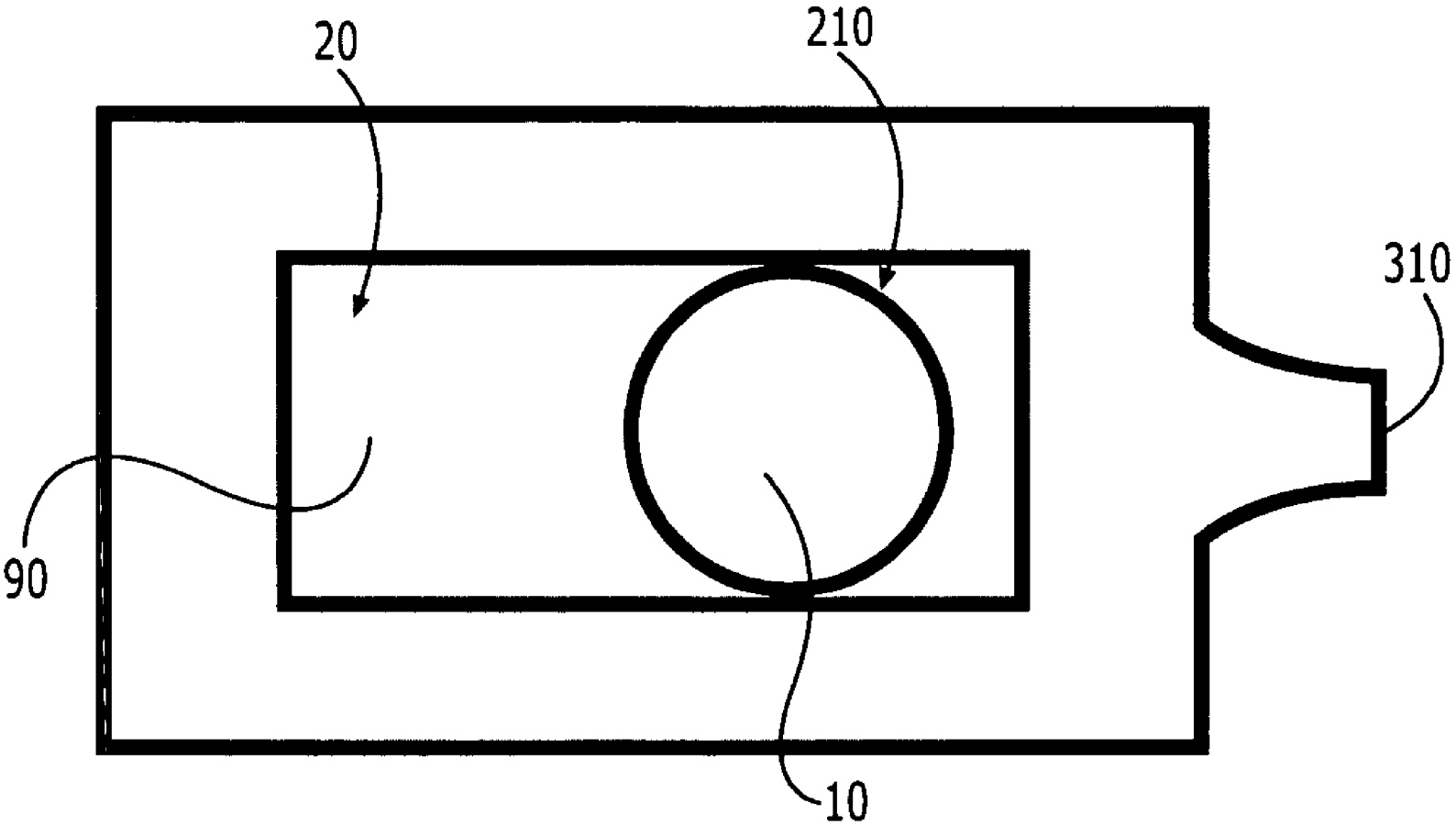

FIG. 13 is a top-view representation of a generally rectangular planar shaped flexible substrate disposed on the second cover and surrounding the transducer gasket, in accordance with an embodiment of the present invention.

Figure 14:
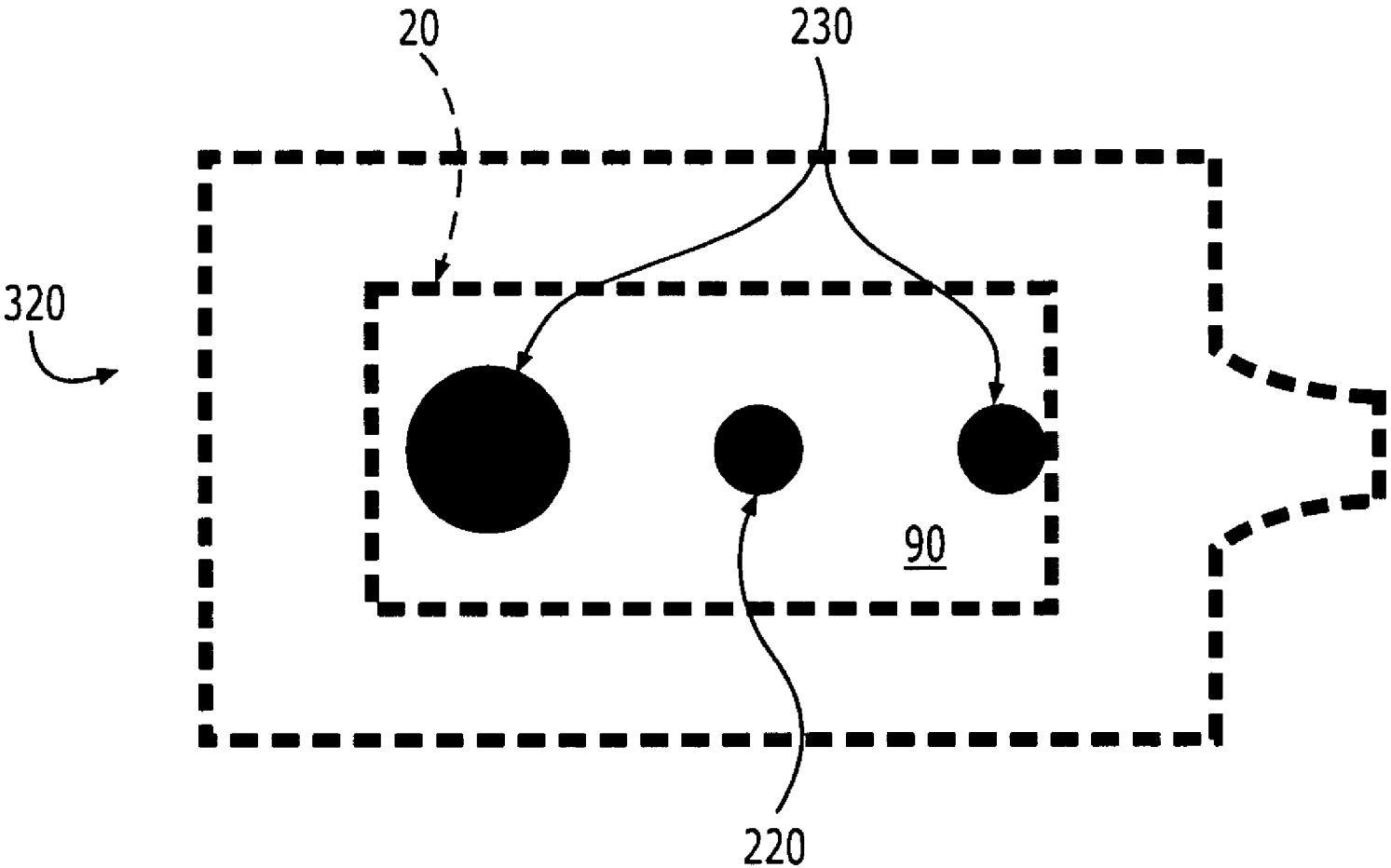

FIG. 14 is a top-view representation of a generally rectangular planar shaped flexible substrate underlying the third cover, in accordance with an embodiment of the present invention.

Figure 15:
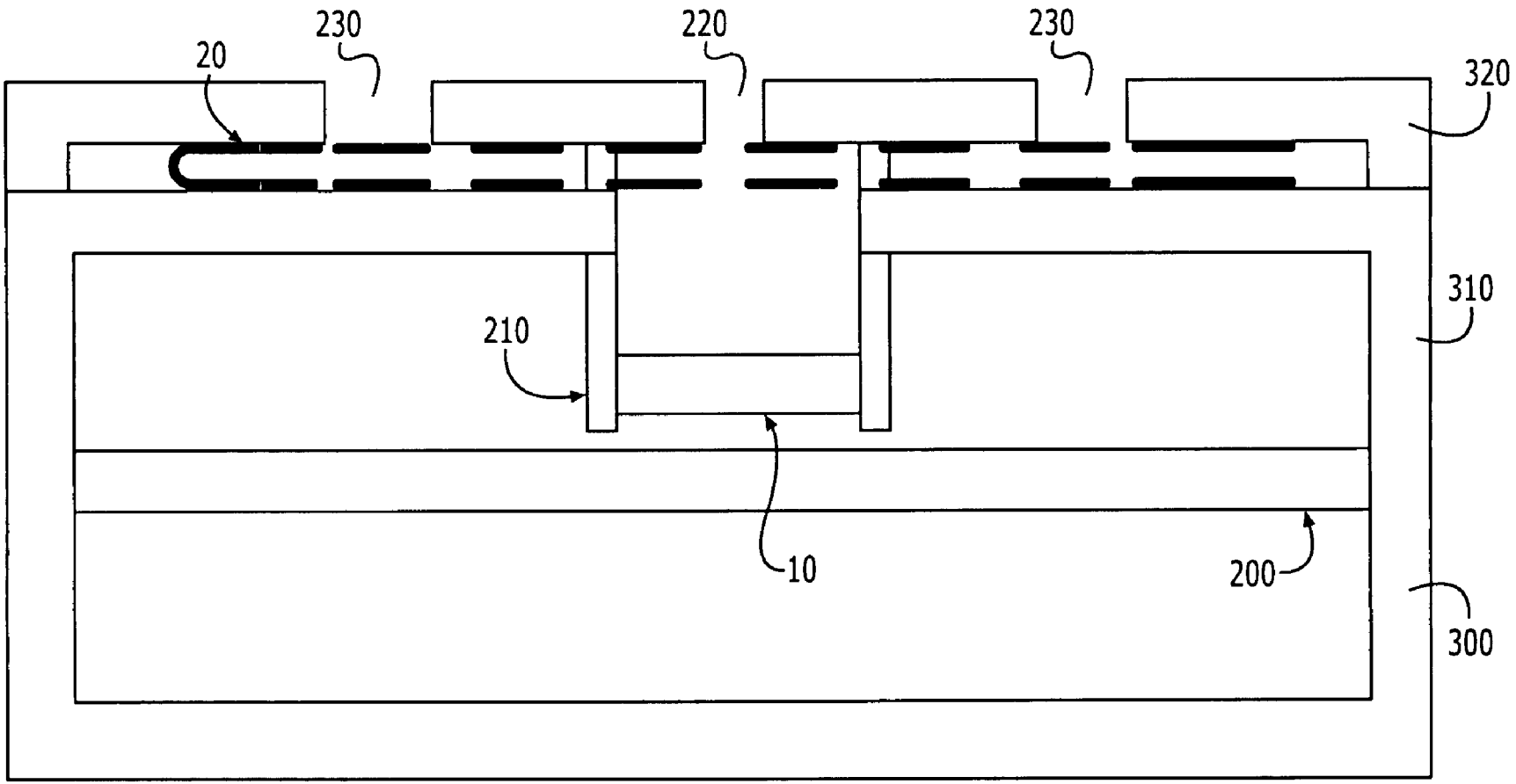

FIG. 15 is a cross-sectional diagram of the interior of a mobile telephone highlighting the disposal of a folded flexible substrate having a magnetic coil on the second cover, in accordance with an embodiment of the present invention.

Figure 16:
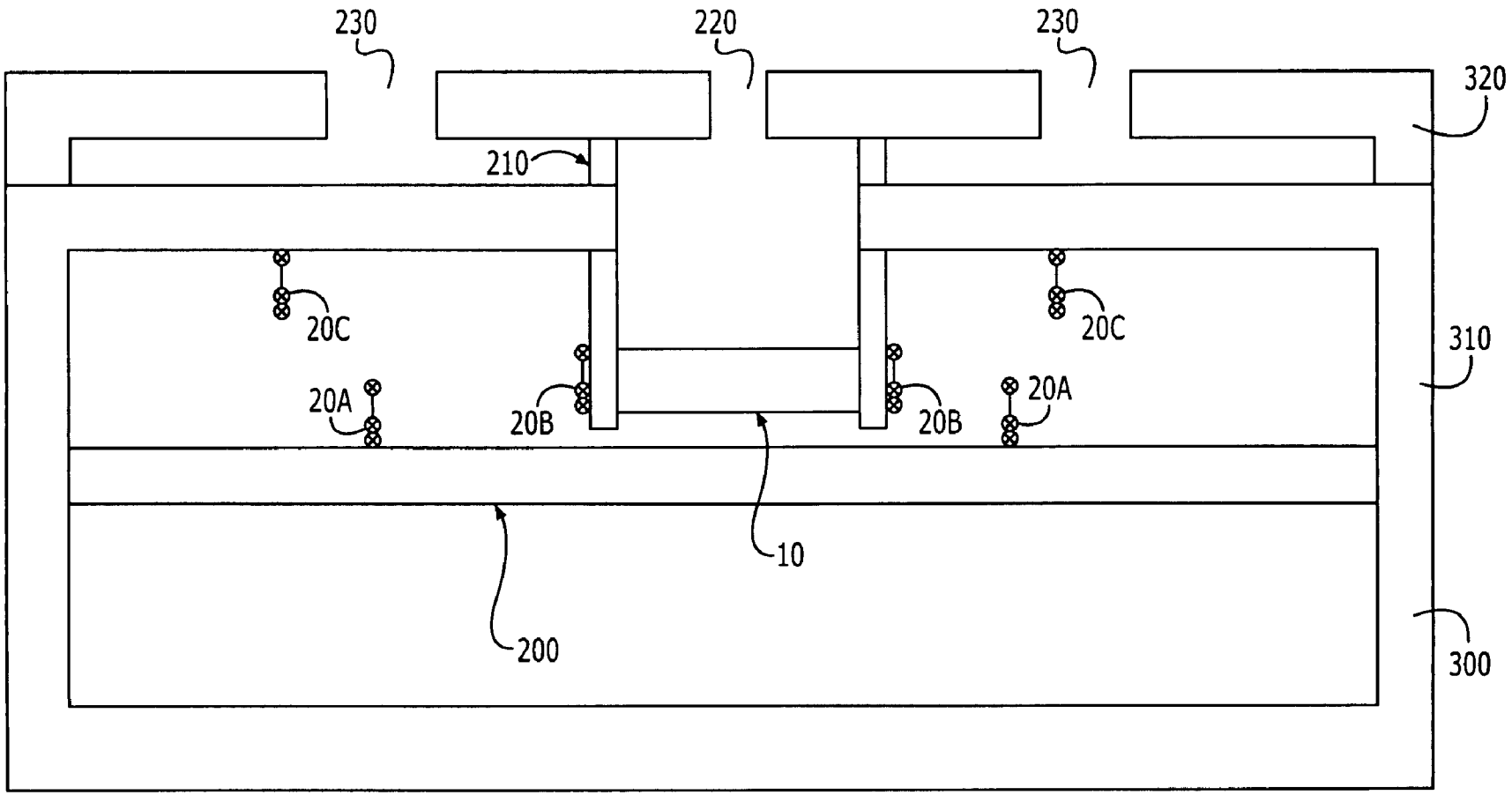

FIG. 16 a cross-sectional diagram of the interior of a mobile telephone highlighting various areas in the mobile telephone for the placement of a magnetic coil, in accordance with an embodiment of the present invention.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The present invention provides for an audio device having a magnetic coil that is in electrical communication with a driver circuit of the audio device. Typically the audio device will be mobile terminal, such as a mobile telephone or the like. Additionally, the magnetic coil may be in electrical communication, in series or in parallel, with a transducer, such as a transducer that emits audible sound. The electrical schematic configuration of the driver/coil/transducer will be dictated by the many factors, such as pre-existing electrical design, space limitations and other concerns. FIGS. 1A-1F provide for examples of electrical configurations, in which the audio device of the present invention embodies a magnetic coil, a driver circuit and a transducer.

FIG. 1A provides a schematic diagram of the electrical communication between the transducer 10, the magnetic coil 20 and a driver circuit 30, in which the components are in serial electrical communication, in accordance with an embodiment if the present invention.

FIG. 1B provides a schematic diagram of the electrical communication between the transducer 10, the magnetic coil 20 and the driver circuit 30, in which the components are in parallel electrical communication, in accordance with an alternate embodiment of the present invention. In the FIG. 1B embodiment optional resistor 40 may be necessary to regulate the flow of current through the magnetic coil.

FIGS. 1C-1F provide schematic diagrams of embodiments of the invention in which separate drivers are implemented to individually drive the transducer and the magnetic coil. Each driver can be used at the same time or separately to provide for a corresponding "acoustic/audio" mode and "coil" mode. Additionally, the input and output of each driver may be single ended or differential.

FIG. 1C provides a schematic diagram of the electrical communication between the transducer 10, the magnetic coil 20, transducer driver 32 and magnetic coil driver 34, in accordance with an embodiment of the present invention. As depicted the components are in parallel electrical communication. Optional resistor 40 may also be necessary to regulate the flow of current through the magnetic coil.

FIG. 1D provides a schematic diagram of the electrical communication between the transducer 10, the magnetic coil 20, transducer driver 32 and magnetic coil driver 34, in accordance with an embodiment of the present invention. As depicted the components are in serial electrical communication. Optional resistor 40 may also be necessary to regulate the flow of current through the magnetic coil.

FIG. 1E provides schematic diagrams of the electrical communication between the transducer 10 and a transducer driver 32 and the magnetic coil 20 and the magnetic coil driver 34. In this embodiment, the magnetic coil is not in electrical communication with the transducer but still generates a magnetic field that serves to increase the overall magnetic field in the audio device. Optional resistor 40 may also be necessary to regulate the flow of current through the magnetic coil.

FIG. 1F provides a schematic diagram of the electrical communication between the transducer 10, the magnetic coil 20, transducer driver 32 and magnetic coil driver 34, in accordance with an embodiment of the present invention. As depicted the components are in parallel electrical communication. The transducer driver is fully differential (both input and output) and the magnetic coil driver input is single ended with the output being differential. Optional resistor 40 may also be necessary to regulate the flow of current through the magnetic coil.

The magnetic coil is typically physically positioned proximate the transducer of the audio device. Positioning the magnetic coil proximate the transducer insures that the magnetic field from the coil is coupled with the magnetic field from the transducer to provide requisite magnetic field emissions for hearing-aid compatibility. In certain embodiments, the transducer may not emit any magnetic field, such as in the case of an audio device embodying a piezoelectric transducer. In such embodiments, the magnetic coil described in this invention is typically located within the audio device at a position which is proximate the users ear or proximate the hearing aid pickup coil.

However, in other embodiments of the invention the magnetic coil may be remote from the transducer, typically positioned proximate the ear of the audio device user or proximate the hearing aid pickup coil. For example the magnetic coil described in this invention, in the form of a flexible magnetic coil may be provided for within a helmet, hat, other headgear or other object that is proximate a user's ear with electrical communication provided between the flexible magnetic coil and the remote audio device, such as a remote cellular telephone. It should be noted that these head coverings may or may not be equipped with a transducer device and, as such, may be specifically designed to impart magnetic field emission to the hearing-aid user of the audio device.

The magnetic coil of the present invention is suited for any audio device that may require hearing-aid compatibility. For example, the audio device may include a mobile or landline telephone, a telephone headset, audio headphones, audio ear buds or any other audio device. It is especially suited for audio devices having space limitations, such as telephones, audio headsets, audio headphones, audio ear buds or the like.

In addition to the audio devices equipped with an audio transducer described above, the audio device of the present invention may be specifically designed for hearing-aid users. In such embodiments the audio device may be limited to emission of low frequency magnetic field with no other audible frequency emissions. As such, these hearing-aid specific devices do not require an audio transducer.

As will be discussed and shown at length infra, the magnetic coil will typically be a multi-turn coil and in many embodiments the coil will be arranged in multiple layers or in multiple planes. The magnetic coil may be disposed on a flexible substrate, disposed on or within the device's printed circuit board or the magnetic coil may be free-standing (i.e., unsupported by a substrate). In an alternate embodiment, the coil may be remote from audio device housing, such as in embodiments in which the coil is a flexible coil embedded within a helmet, hat, some other form of head gear or any other object that is proximate a user's ear. The coil will typically be formed of copper, copper alloy or any other suitable conductive material.

FIG. 2 provides a top view of a magnetic coil 20 having a generally rectangular planar shape that is formed on a flexible substrate 50, in accordance with an embodiment of the invention. The flexible substrate may be formed of any suitable flexible substrate material having dielectric characteristics, such as polyamide or the like. In the illustrated embodiment the coil includes turns that are disposed on both planar sides of the flexible substrate. The dotted lines 22 illustrate turns of the coil that are disposed on the underside of the flexible substrate and the solid lines 24 illustrate turns of the coil that are disposed on the topside of the flexible substrate. Vias 60 formed in the flexible substrate provide for the interconnection of the turns disposed on the underside and the topside of the substrate. The magnetic fields of all the turns disposed on both sides of the substrate are added together to create a cumulative increased magnetic field. The tab 70 of the flexible substrate provides an area for disposal of connector pads 80. Electrical connection between the magnetic coils and driver circuit can be made via electrical pads, plugs or any type of electrical connection. The number of connector pads is dependent upon the number of separate coils disposed on the substrate and can be defined as 2N, where N equals the number of separate coils disposed on the substrate.

The generally rectangular planar shape of the flexible substrate shown in FIG. 2 allows for a transducer (not shown in FIG. 2) to generally underlie the open region 90 of the substrate and for a sound port (not shown in FIG. 2) and one or more leaky holes (not shown in FIG. 2) to generally overlie the open region of the substrate.

FIG. 3 provides a top view of a magnetic coil 20 having a generally circular shape that is formed on a flexible substrate 50, in accordance with an embodiment of the invention. Similar to the FIG. 2 embodiment, the magnetic coil shown in FIG. 3 includes turns that are disposed on both planar sides of the flexible substrate. The dotted lines 22 may illustrate turns of the coil that are disposed on the underside of the flexible substrate and the solid lines 24 may illustrate turns of the coil that are disposed on the topside of the flexible substrate. It is also possible for the turns of the coil to be superimposed on each other; as such the solid and dotted lines would be indiscernible in the top views of FIGS. 2 and 3. Vias 60 formed in the flexible substrate provide for the interconnection of the turns disposed on the underside and the topside of the substrate. The tab 70 of the flexible substrate provides an area for disposal of connector pads 80.

The generally circular planar shape of the flexible substrate shown in FIG. 3 allows for the substrate to be positioned around the periphery of a transducer gasket (not shown in FIG. 4) such that the transducer (not shown in FIG. 3) will generally underlie the open region 90 of the substrate. It should be noted that the rectangular planar shape of FIG. 2 and the circular planar shape of FIG. 3 is by way of example only. Other planar shapes, which are conducive to the interior design of the device housing and which further an increase in magnetic field, are also contemplated and within the inventive concepts herein disclosed.

FIGS. 4A and 4B illustrate a top view of a magnetic coil 20 disposed on a rectangular flexible substrate 50 and the cross-sectional side view of the coil wires that make up the layered construct, in accordance with an embodiment of the present invention. In the illustrated embodiment the upper side of the flexible substrate has N number of layers disposed on it and the lower side of the flexible substrate has M number of layers disposed on it. The number of layers disposed on the upper and lower sides of the flexible substrate is not required to be equal in number. In the illustrated embodiment the upper layers have two turns of the coil 24 and the lower layers have three turns of the coil 22. The number of coil turns in any one layer is shown by way of example only.

In the illustrated embodiment of FIG. 4B the layers of magnetic coil are spaced apart and separated by a layer of dielectric adhesive material 100. In an alternate embodiment the layers of magnetic coil may be separated by layers of flexible dielectric material, such as polyamide or any other suitable flexible dielectric material having suitable heat resistant characteristics.

It is noted that while the embodiments illustrated in FIGS. 2-4 depict and are described as having magnetic coil turns formed on both sides of the flexible substrate it is also possible, and within the inventive concepts herein disclosed, to dispose layers of turns on only one side of the flexible substrate. In such an embodiment the flexible substrate would not require the formation of vias as through-holes in the substrate.

FIG. 5 illustrates an alternate embodiment of the present invention, depicting a flexible substrate having a fold region. In the illustrated embodiment the flexible substrate 50 has two coil units 110 and 120. In the illustrated embodiment the coil units have a generally symmetrical rectangular planar shape; however, the shape of the coil unit shown is by way of example only and the units may be symmetrical or asymmetrical. The flexible substrate allows for the folding of the substrate at the fold region 130. Typically, the flexible substrate will be folded approximately 180 degrees along the fold axis 140, such that, one coil unit is superimposed on the other coil unit.

FIG. 6 illustrates the flexible substrate having a fold region and having coil turns disposed on the coil units. In the illustrated embodiment of the invention the coil units 110 and 120 have coil turns 22 and 24 disposed on both sides of the flexible substrate 50. In alternate embodiments, the coil turns may be disposed on only one side of the flexible substrate. Vias 60 formed in the flexible substrate provide for the interconnection of the turns disposed on the underside and the topside of the flexible substrate. Once the unit has been folded, approximately 180 degrees, along the fold axis 140, the double-layered coil units will act as a four-layered structure having the cumulative magnetic field of all four layers. Additionally, upon folding the tabs 70 of the flexible substrate will be generally superimposed upon each other provide for the connector pads 80 to accommodate electrical connection between the magnetic coils and a driver circuit.

FIG. 7 illustrates the flexible substrate having multiple fold regions and more than two magnetic coil regions, in accordance with an embodiment of the present invention. In the illustrated embodiment the flexible substrate includes magnetic coil units 110 and 120 and an Nth magnetic coil unit 150 formed at the end of a continuous chain of magnetic coil units. A fold region 130 separates each magnetic coil unit in the chain. The flexible substrate is folded along the fold axis 140 of the fold region to create multiple folds of stacked coil units. Each layer of coil turns within the stacked arrangement will provide a magnetic field that is summed to create an increase in the composite mobile telephone magnetic field emission.

FIGS. 8A-8C illustrate an alternate embodiment of the flexible substrate having multiple fold regions, more than two magnetic coil regions and asymmetrical coil overlapping, in accordance with an embodiment of the present invention. In the FIG. 8A embodiment the flexible substrate includes magnetic coil units 110 and 120 and an nth magnetic coil unit 150 formed at the end of a continuous chain of magnetic coil units. However, unlike the embodiment shown in FIG. 7, the FIG. 8 embodiment will result in an asymmetrical stacked arrangement of coil units once the units have been folded along the fold axis. This embodiment of the invention illustrates that the stacks or layers of magnetic coil turns need not be symmetric in configuration and in some embodiments may benefit from having an asymmetric configuration.

FIG. 8B provides further illustration of a continuous chain of magnetic coil units. In addition to magnetic coil units 110 and 120 and Nth magnetic coil unit 150, the assembly of coil units includes Mth magnetic coil unit 152, Pth magnetic coil 154, Rth magnetic coil 156 and Sth magnetic coil 158. In the configuration shown, the units may be folded 180 degrees along the fold axis 140 to create an asymmetrical stack of the units or the units may be folded in other arrangements, at predefined fold angles, to provide for one or more coil units to be located within specific predefined areas of the device housing. FIG. 8C provides an additional illustration of a continuous chain of magnetic coil units. In this embodiment the planar shape of the coil units have been varied as well as the point of attachment for the fold region 130. The number of units in the chain, the location of the point of attachment, the planar shape of the units and the fold configuration will be dictated by factors that include, but are not limited to, magnetic field requirements, space limitations within the interior of the device, transducer and ear port configurations and the like. Alternatively, the magnetic coil may be disposed on or within the audio device's printed circuit board, in accordance with an alternative embodiment of the present invention. In such embodiments the magnetic coil may be printed on the circuit board, using conventional photolithography techniques or other conventional semiconductor processing techniques, or the magnetic coil may be attached, after conventional semiconductor processing is completed, using adhesive layer bonding. Additionally, the magnetic coil may be disposed on one or both sides of the printed circuit board. Alternatively, the coils may be disposed within the printed circuit board during fabrication of multi-layered boards. FIGS. 9 and 10 provide examples of top view layouts of magnetic coils disposed on printed circuit boards.

FIG. 9 provides a top view of a magnetic coil 20 having a generally rectangular shape that is disposed on a printed circuit board 200, in accordance with an embodiment of the invention. In the illustrated embodiment the magnetic coil includes turns that are disposed on both planar sides of the printed circuit board or within the printed circuit board. The dotted lines 22 illustrate turns of the coil that are disposed on the underside of the printed circuit board and the solid lines 24 illustrate turns of the coil that are disposed on the topside of the printed circuit board. Alternatively, the dotted lines may refer to coils disposed within the PCB with the solid lines referring to coils disposed on the PCB. Also, the dotted lines may refer to coils disposed within one layer of the PCB construct with the solid lines referring to coils disposed within another layer of the PCB construct. The bold-faced dotted lines 210 are illustrative of the magnetic coil extension limits and do not actually exist on the printed circuit board. Vias 60 formed in the flexible substrate provide for the interconnection of the turns disposed on the underside and the topside of the printed circuit board. The magnetic fields of all the turns disposed on both sides of the printed circuit board are added together to create a cumulative increased magnetic field.

FIG. 10 provides a top view of a magnetic coil 20 having a generally circular shape that is formed on a printed circuit board 200, in accordance with an embodiment of the invention. Similar to the FIG. 9 embodiment, the magnetic coil shown in FIG. 9 includes turns that are disposed on both planar sides or within the printed circuit board. The dotted lines 22 illustrate turns of the coil that are disposed on the underside of the printed circuit board and the solid lines 24 illustrate turns of the coil that are disposed on the topside of the printed circuit board. Alternatively, the dotted lines may refer to coils disposed within the PCB with the solid lines referring to coils disposed on the PCB. Also, the dotted lines may refer to coils disposed within one layer of the PCB construct with the solid lines referring to coils disposed within another layer of the PCB construct. The bold-faced dotted lines 210 are illustrative of the magnetic coil extension limits and do not actually exist on the printed circuit board. Vias 60 formed in the flexible substrate provide for the interconnection of the turns disposed on the underside and the topside of the printed circuit board. The connector pads 80 provide electrical connection between the magnetic coils and driver circuit.

In addition to disposing the magnetic coil on a flexible substrate or on the mobile telephone's printed circuit board, an alternate embodiment of the invention provides for the magnetic coil to a freestanding unit, unsupported by a substrate. In these embodiments, the magnetic coil may be a multi-turn coil formed generally on a single plane or the magnetic coil may a multi-turn, layered structure formed on multiple planes. The multi-turn, layered structure may be formed on a release layer or release substrate that is subsequently removed after the structure has been fabricated. Typically, the layers of coil in the freestanding unit will be spaced apart and separated by dielectric adhesive layers or some other form of a dielectric material.

FIGS. 11-16 provide cross-sectional side and top views of the interior cavity of an audio device, such as a mobile telephone and examples of locations within the interior cavity for placement of the magnetic coil. FIG. 11 provides a cross-sectional, side-view of the interior of a device in which the magnetic coils are disposed on or within the printed circuit board assembly. The device cover 300, which typically serves as the back face for the device, supports the printed circuit board 200. Magnetic coil assemblies 20 have been disposed on both the front side and backside planar surfaces of the printed circuit board. It is noted that while the magnetic coil assemblies are shown to be located above and below the printed circuit board, this configuration is by way of example only. The magnetic coil assemblies may be disposed such that they are located within the layered structure of the printed circuit board. The transducer 10 will typically be located proximate the printed circuit board and, as such, magnetic field emitted from the transducer will be combined with the magnetic field generated by the coil to result in an overall increased magnetic field emission.

FIG. 12 provides a cross-sectional, side-view of the interior of an audio device, such as a mobile telephone, in which a magnetic coil disposed on a flexible substrate has been situated. The audio device housing includes three separate covers. The first cover 300 typically serves as the back face and supports the printed circuit board. The second cover 310 is attached to the first cover and serves to support the transducer gasket 210. The third cover 320 is attached to the second cover and provides for the sound port 220 and leaky holes 230. In the illustrated embodiment the magnetic coil is disposed on a generally rectangular-shaped, flexible substrate and the substrate is attached or otherwise affixed to the outermost surface of the second cover Alternatively, the flexible substrate coil can be attached, embedded or otherwise affixed to any of the device's covers (i.e., the active, permanent cover that provides for electrical signal communication, the replaceable cover or any other device cover). It is also noted that the magnetic coil assembly shown in FIG. 12 may be an unsupported, substrate-free, magnetic coil assembly, as described supra.

FIG. 13 provides a top view of the audio device prior to affixing the third cover. The magnetic coil is disposed on or within the generally rectangular-shaped, flexible substrate and the substrate is affixed to the outermost surface of the second cover 310. The open region 90 of the coil assembly surrounds the transducer gasket 210, which serves as the support for the underlying transducer 10. FIG. 14 provides a top view of the audio device after the third cover 320 has been affixed. The open region 90 of the magnetic coil assembly 20 generally underlies the sound port 220 and the optional leaky ports 230.

FIG. 15 provides a cross-sectional, side-view of the interior of an audio device, such as a mobile telephone, in which a magnetic coil disposed on a generally rectangular-shaped, folded, flexible substrate has been situated. FIG. 15 is identical to FIG. 12 except that the magnetic coil 20 assembly is a dual-unit, folded flexible substrate. In this regard, FIGS. 13 and 14 also provide top view perspective of a magnetic coil disposed on a generally rectangular-shaped, folded, flexible substrate.

FIG. 16 provides a cross-sectional view of the interior of an audio device, such as a mobile telephone and areas within the interior of the device where the magnetic coil assembly may be situated, in accordance with embodiments of the present invention. It should be noted that the areas described in FIG. 16 are by way example only and other areas within the device may also provide the basis for the magnetic coil assembly. Also, the magnetic coil assembly that is described in conjunction with FIG. 16 may be disposed on a flexible substrate, disposed on a folded, flexible substrate or an unsupported, substrate-free, magnetic coil assembly. The magnetic coil assembly 20A may be affixed or otherwise attached to the printed circuit board 200. Unlike the previous embodiment, in which the magnetic coil is typically fabricated into the printed circuit board assembly, in this embodiment the flex substrate, the folded-flex substrate or the free-standing coil assembly are typically attached to the side of the printed circuit board that is closest to the transducer 10.

Additionally, the magnetic coil assembly 20B may surround the periphery of the transducer gasket 210 or the transducer 10. As such, the magnetic coil assembly would typically conform in shape to the shape of the periphery of the gasket or the transducer. Thus, if the gasket or transducer is circular in shape the corresponding coil assembly would be generally circular in shape and if the gasket or transducer is square in shape the corresponding coil assembly would be generally square in shape. In the illustrated embodiment, the coil assembly is shown surrounding the periphery of the gasket nearest the transducer 10. However, in alternate embodiments the coil assembly could surround the periphery of the gasket proximate either side of the second cover 310 or anywhere else along the height of the gasket. The coil assembly that surrounds the periphery of the gasket may include a flexible substrate, a folded flexible substrate or a freestanding coil assembly.

The magnetic coil assembly 20C may also be located along the underside of the second cover 310. Typically, in this embodiment the coil assembly will have a generally rectangular planar shape to allow for the magnetic field emitted by the coils to interact with the optional leaky holes 230 and the sound port 220. The coil assembly, such as the flexible substrate assembly, the folded flexible substrate assembly or the free-standing coil assembly, may be affixed to the second cover using a dielectric adhesive, a wire coating or other suitable dielectric material.

Thus, the present invention provides a simplistic apparatus that results in sufficient increase in the emission of magnetic field within an audio device. The increase in magnetic field resulting from the invention will allow devices, such as mobile telephones to comply with the pending FCC regulations for hearing-aid compatibility. The magnetic coil of the present invention can be designed in various formats and located in various positions within the audio device, thus allowing for the coil to provide sufficient increase in magnetic field while adhering to the space limitation concerns within the interior confines of the device. Additionally, the proposed designs can be manufactured and implemented in cost efficient manners.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An audio device, the device comprising:

one or more driver circuits;

a transducer in electrical communication with one of the one or more driver circuits;

a magnetic coil in electrical communication with one of the one or more driver circuits that provide for a magnetic field emission that combines with any other audio device magnetic fields to result in an overall increased magnetic field;

a substrate upon which the magnetic coil is disposed on the substrate; and a printed circuit board to which the substrate is attached, wherein the printed circuit board includes the one or more driver circuits.

2. The audio device of claim 1, wherein the magnetic coil is provided for Hearing Aid Compatibility (HAC).

3. The audio device of claim 1, wherein the transducer provides for a transducer magnetic field, such that the coil magnetic field emission combines the transducer magnetic field emission to result in an overall increased magnetic field.

4. The audio device of claim 1, wherein the magnetic coil is formed in a single-turn arrangement.

5. The audio device of claim 1, wherein the magnetic coil is formed in a multi-turn arrangement.

6. The audio device of claim 1, wherein the magnetic coil is formed in a single-layer arrangement.

7. The audio device of claim 1, wherein the magnetic coil is formed in a multi-layer arrangement.

8. The audio device of claim 1, wherein the substrate is flexible.

9. The audio device of claim 8, wherein the magnetic coil is disposed on both planar sides of the flexible substrate.

10. The audio device of claim 8, wherein the magnetic coil is disposed on a flexible substrate that is capable of being folded within a mobile telephone apparatus.

11. The audio device of claim 8, wherein the magnetic coil is arranged in multiple layers on a planar side of the flexible substrate.

12. The audio device of claim 11, wherein the magnetic coil comprises a dielectric adhesive layer separating each of the multiple layers.

13. The audio device of claim 8, wherein the magnetic coil is arranged in multiple layers on both planar sides of the flexible substrate.

14. The audio device of claim 13, wherein the multiple layers are each separated by a dielectric adhesive layer.

15. The audio device of claim 1, wherein the magnetic coil comprises a dielectric adhesive layer separating each of a plurality of coil layers.

16. The audio device of claim 1, wherein the transducer and the magnetic coil are in electrical communication with the same driver circuit.

17. The audio device of claim 16, wherein the driver, the transducer and the magnetic coil are electrically connected in series.

18. The audio device of claim 16, wherein the driver, the transducer and the magnetic coil are electrically connected in parallel.

19. The audio device of claim 1, wherein the transducer is in electrical communication with a first driver circuit and the magnetic coil is in electrical communication with a second driver circuit.

20. The audio device of claim 1, further comprising a first device cover that encloses the printed circuit board, a second device cover adjacent to the first device cover that encloses a transducer gasket that supports the transducer, and a third device cover adjacent to the second device cover that includes a sound port.

21. The audio device of claim 20, wherein the magnetic coil generally surrounds the transducer gasket.

22. The audio device of claim 20, wherein the magnetic coil generally surrounds the transducer.

23. The audio device of claim 1, wherein the magnetic coil is located proximate the transducer within an audio device housing.

24. A hearing-aid compatible audio device, the device comprising:

a driver circuit;

a transducer in electrical communication with the driver circuit;

a magnetic coil in electrical communication with the driver circuit that provides for a magnetic field emission that combines with other audio device magnetic fields to result in an overall increased magnetic field;

a substrate upon which the magnetic coil is disposed; and a printed circuit board to which the substrate is attached, wherein the printed circuit board includes the one or more driver circuits.

25. The hearing-aid compatible audio device of claim 24, wherein the magnetic coil is formed in a single-turn arrangement.

26. The hearing-aid compatible audio device of claim 24, wherein the magnetic coil is formed in a multi-turn arrangement.

27. The hearing-aid compatible audio device of claim 24, wherein the magnetic coil is formed in a single-layer arrangement.

28. The hearing-aid compatible audio device of claim 24, wherein the magnetic coil is formed in a multi-layer arrangement.

29. The hearing-aid compatible audio device of claim 24, wherein the substrate is flexible.

30. The hearing-aid compatible audio device of claim 29, wherein the magnetic coil is disposed on a flexible substrate that is capable of being folded within a mobile telephone apparatus.

31. The hearing-aid compatible audio device of claim 24, wherein the printed circuit board includes one or more driver circuits.

32. A method comprising:

providing for a transducer associated with an audio device that is in electrical communication with an audio driver circuit, providing for a magnetic coil associated with the audio device that is in electrical communication with the audio device driver circuit, providing for a substrate upon which the magnetic coil is disposed, providing for a printed circuit board to which the substrate is attached, the printed circuit board including the audio device driver circuit, and driving the magnetic coil with the driver circuit during device operation to provide a magnetic field emission that combines with any other audio device magnetic field to result in an increased magnetic field.

33. The method of claim 32, wherein the step of driving the magnetic coil with the driver circuit during device operation to provide a magnetic field emission that combines with any other audio device magnetic field to result in an increased magnetic field is further defined as being performed for the purpose of Hearing Aid Compatibility (HAC).

34. The method of claim 32, wherein the step of providing for a substrate further comprises providing for a flexible substrate.

35. The method of claim 32, wherein the step of providing for a substrate further comprises providing for a flexible substrate that is foldable so as to result in a stacked coil arrangement.

36. The method of claim 32, wherein the step of providing a magnetic coil further comprises providing a magnetic coil that is unsupported by a substrate and is proximate to the transducer of the device.

* * * * *